US008109433B2

(12) United States Patent
De Paula et al.

(10) Patent No.: US 8,109,433 B2
(45) Date of Patent: Feb. 7, 2012

(54) GUSSETED CARTON

(75) Inventors: Andrea Coltri De Paula, Marietta, GA (US); Leonard M. Cooper, Powder Springs, GA (US); Jean-Manuel Gomes, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 373 days.

(21) Appl. No.: 12/423,075

(22) Filed: Apr. 14, 2009

(65) Prior Publication Data

US 2009/0255983 A1 Oct. 15, 2009

Related U.S. Application Data

(60) Provisional application No. 61/044,583, filed on Apr. 14, 2008, provisional application No. 61/048,348, filed on Apr. 28, 2008.

(51) Int. Cl.
*B65D 17/28* (2006.01)
*B65D 5/355* (2006.01)

(52) U.S. Cl. ..... 229/101; 229/186; 229/240; 229/243; 229/244

(58) Field of Classification Search ..... 229/101, 229/101.2, 143, 144, 147, 154, 186, 240–244; 206/427

See application file for complete search history.

(56) References Cited

U.S. PATENT DOCUMENTS

| | | | | |
|---|---|---|---|---|
| 1,253,193 | A | | 1/1918 | Hill |
| 2,594,376 | A | | 4/1952 | Arneson |
| 2,810,506 | A | * | 10/1957 | Kessler ..... 229/101 |
| 2,819,506 | A | | 10/1957 | Kessler |
| 2,868,433 | A | | 1/1959 | Anderson, Jr. |
| 2,955,739 | A | | 10/1960 | Collura |
| 3,027,063 | A | * | 3/1962 | Zastrow ..... 229/155 |
| 3,112,856 | A | | 12/1963 | MacIntosh et al. |
| 3,127,720 | A | | 4/1964 | Gentry et al. |
| 3,176,904 | A | * | 4/1965 | Collura ..... 229/137 |
| 3,204,814 | A | | 9/1965 | Mahon |
| 4,036,423 | A | | 7/1977 | Gordon |
| 4,136,816 | A | * | 1/1979 | Gardner ..... 229/144 |
| 4,216,861 | A | | 8/1980 | Oliff |
| 4,328,923 | A | | 5/1982 | Graser |
| 4,378,905 | A | | 4/1983 | Roccaforte |
| 4,498,619 | A | | 2/1985 | Roccaforte |
| 4,546,914 | A | | 10/1985 | Roccaforte |
| 4,577,799 | A | | 3/1986 | Oliff |

(Continued)

FOREIGN PATENT DOCUMENTS

CA 2 160 145 9/1995

(Continued)

OTHER PUBLICATIONS

International Search Report and Written Opinion—PCT/US2009/040424.

*Primary Examiner* — Gary Elkins

(74) *Attorney, Agent, or Firm* — Womble Carlyle Sandridge & Rice, LLP

(57) ABSTRACT

A carton is formed from a blank having gusseted corners that in part form an interior carton volume. The interior volume of the carton can be varied by placing the carton in an expanded configuration. The carton can include a bottom receptacle portion that may be liquid-tight.

26 Claims, 18 Drawing Sheets

U.S. PATENT DOCUMENTS

| | | | | |
|---|---|---|---|---|
| 4,588,084 | A | 5/1986 | Holley, Jr. | |
| 4,747,487 | A | 5/1988 | Wood | |
| 4,979,669 | A * | 12/1990 | Kerton | 229/144 |
| 5,020,337 | A | 6/1991 | Krieg | |
| 5,094,359 | A * | 3/1992 | DeMars et al. | 229/101 |
| 5,197,598 | A | 3/1993 | Stout et al. | |
| 5,246,112 | A | 9/1993 | Stout et al. | |
| 5,292,058 | A | 3/1994 | Zoss et al. | |
| 5,297,725 | A | 3/1994 | Sutherland | |
| 5,333,734 | A | 8/1994 | Stout et al. | |
| 5,472,090 | A | 12/1995 | Sutherland | |
| 5,495,727 | A | 3/1996 | Strong et al. | |
| 5,551,566 | A | 9/1996 | Sutherland | |
| 5,582,343 | A | 12/1996 | Dalvey | |
| 5,639,017 | A | 6/1997 | Fogle | |
| 5,704,470 | A | 1/1998 | Sutherland | |
| 5,738,273 | A | 4/1998 | Auclair | |
| 5,794,778 | A | 8/1998 | Harris | |
| 5,826,782 | A | 10/1998 | Stout | |
| 5,873,515 | A | 2/1999 | Dunn et al. | |
| 5,915,546 | A | 6/1999 | Harrelson | |
| 5,992,733 | A | 11/1999 | Gomes | |
| 6,021,897 | A | 2/2000 | Sutherland | |
| 6,065,590 | A | 5/2000 | Spivey | |
| 6,085,969 | A | 7/2000 | Burgoyne | |
| 6,112,977 | A | 9/2000 | Sutherland et al. | |
| 6,164,526 | A | 12/2000 | Dalvey | |
| 6,170,741 | B1 | 1/2001 | Skolik et al. | |
| 6,227,367 | B1 | 5/2001 | Harrelson et al. | |
| 6,302,320 | B1 | 10/2001 | Stout | |
| D452,154 | S | 4/2002 | Doucette et al. | |
| 6,631,803 | B2 | 10/2003 | Rhodes et al. | |
| 6,758,337 | B2 | 7/2004 | Chargueraud et al. | |
| 6,834,793 | B2 | 12/2004 | Sutherland | |
| 6,869,009 | B2 | 3/2005 | Sutherland et al. | |
| 6,926,193 | B2 | 8/2005 | Smalley | |
| 6,945,450 | B2 | 9/2005 | Rusnock | |
| 7,234,596 | B2 | 6/2007 | Lebras | |
| 7,296,731 | B2 | 11/2007 | Auclair et al. | |
| 7,380,701 | B2 | 6/2008 | Fogle et al. | |
| 7,416,109 | B2 | 8/2008 | Sutherland | |
| 7,601,111 | B2 * | 10/2009 | Sutherland et al. | 493/68 |
| 7,699,215 | B2 | 4/2010 | Spivey, Sr. | |
| 7,743,944 | B2 | 6/2010 | Ho Fung et al. | |
| 7,806,314 | B2 * | 10/2010 | Sutherland | 229/243 |
| 2006/0071058 | A1 | 4/2006 | Spivey, Sr. | |
| 2006/0081690 | A1 * | 4/2006 | Bates et al. | 229/101 |
| 2006/0273143 | A1 | 12/2006 | Finch | |
| 2007/0051781 | A1 | 3/2007 | Holley, Jr. | |
| 2007/0164091 | A1 * | 7/2007 | Fogle et al. | 229/101 |
| 2007/0181658 | A1 | 8/2007 | Sutherland | |
| 2007/0284424 | A1 | 12/2007 | Holley | |
| 2008/0083820 | A1 | 4/2008 | Walling et al. | |
| 2008/0119344 | A1 | 5/2008 | Sutherland et al. | |
| 2009/0255983 | A1 | 10/2009 | De Paula et al. | |
| 2009/0282843 | A1 * | 11/2009 | Brand | 62/457.1 |
| 2009/0308915 | A1 * | 12/2009 | Brand | 229/240 |

FOREIGN PATENT DOCUMENTS

| | | | |
|---|---|---|---|
| DE | 20 2004 018 649 | U1 | 4/2005 |
| EP | 0 412 226 | A1 | 2/1991 |
| FR | 1 494 239 | | 9/1967 |
| FR | 2 579 175 | | 9/1986 |
| KR | 20-0356729 | Y1 | 7/2004 |
| WO | WO 2007/089282 | | 8/2007 |

* cited by examiner

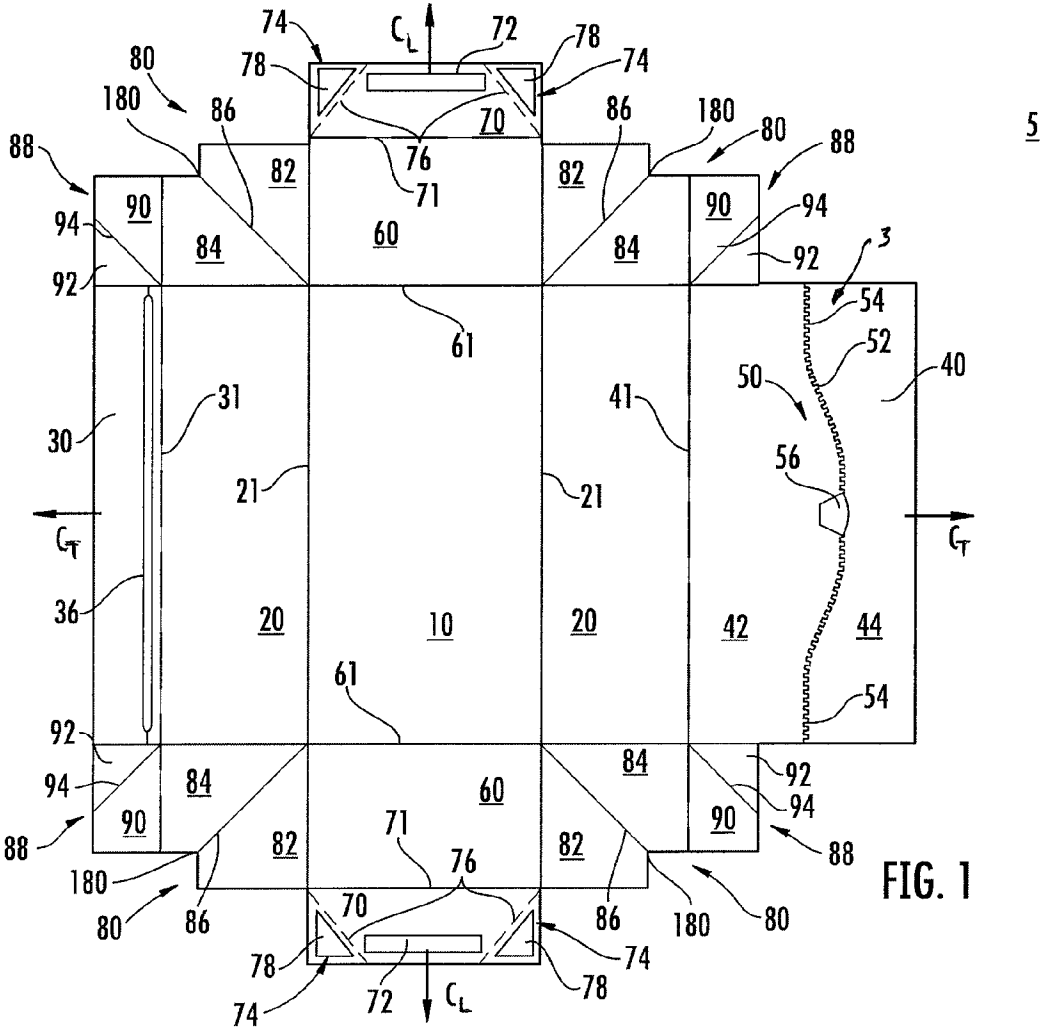
FIG. 1
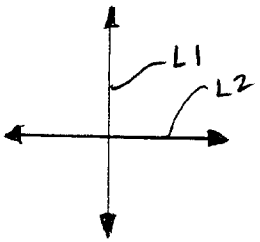

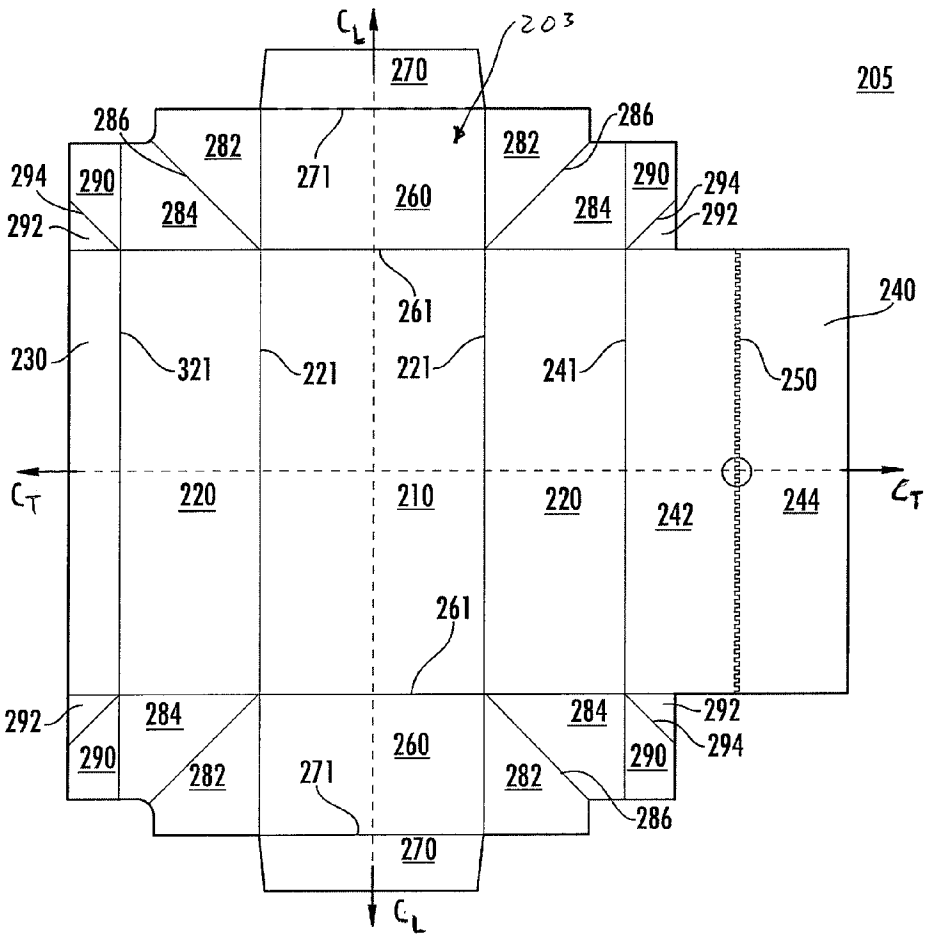
FIG. 9
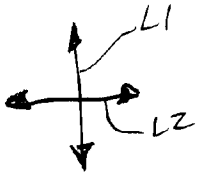

GUSSETED CARTON

CROSS-REFERENCE TO RELATED APPLICATIONS

This application claims the benefit of Provisional Application No. 61/044,583, filed Apr. 14, 2008, and Provisional Application No. 61/048,348, filed on Apr. 28, 2008, the entire contents of which are hereby incorporated by reference.

BACKGROUND OF THE DISCLOSURE

The present disclosure generally relates to a carton for handling and carrying containers, and particularly to cartons having liquid-tight or leakage resistant features.

SUMMARY OF THE DISCLOSURE

In one aspect, the disclosure is generally directed to a carton comprising a first side panel, a bottom panel, a second side panel, a first end panel, a second end panel, and a plurality of gussets. One gusset is located at each corner of the bottom panel and is disposed between and foldably connected to an adjacent side panel and end panel so as to seal or close off the corners of the carton.

In another aspect, the disclosure is generally directed to a carton comprising a bottom panel, a first side panel foldably connected to the bottom panel, a second side panel foldably connected to the bottom panel, a top wall foldably connected to the first side panel and the second side panel, a top wall breachable line of disruption extending at least partially across the top wall, and at least one end wall. The at least one end wall comprises a bottom end panel foldably connected to the bottom panel, at least one lower gusset foldably connected to the bottom end panel and one of the first side panel and the second side panel, and at least one upper gusset foldably connected to the at least one lower gusset and the top wall.

In another aspect, the disclosure is generally directed to a blank for forming a carton. The blank comprises a bottom panel, a first side panel foldably connected to the bottom panel, at least one top panel foldably connected to the first side panel and having a breachable line of disruption extending across the at least one top panel, and a second side panel foldably connected to the bottom panel. The blank further comprises at least one bottom end panel foldably connected to the bottom panel, at least one lower gusset foldably connected to the at least one bottom end panel and one of the first side panel and the second side panel, and at least one first upper gusset foldably connected to the at least one first lower gusset and the at least one top panel.

In another aspect, the disclosure is generally directed to a method of forming a carton for holding a plurality of containers. The method comprises providing a blank comprising a bottom panel, a first side panel foldably connected to the bottom panel, at least one top panel foldably connected to the first side panel and having a breachable line of disruption extending across the at least one top panel, a second side panel foldably connected to the bottom panel, at least one bottom end panel foldably connected to the bottom panel, at least one lower gusset foldably connected to the at least one bottom end panel and one of the first side panel and the second side panel, and at least one first upper gusset foldably connected to the at least one first lower gusset and the at least one top panel. The method further comprises folding the first side panel and the second side panel relative to the bottom panel and the at least one top panel to form a sleeve. The method further comprises folding the bottom end panel so that the least one first lower gusset is folded to form a liquid-tight bottom receptacle and the at least one first lower gusset is folded.

According to one aspect of the disclosure, one or both ends of the carton can be opened to provide access to articles accommodated within the carton interior.

According to another aspect of the disclosure, a top panel can be opened and ice, cold water, additional containers, and/or other articles can be placed in the carton through the opened top end. The interior volume of the carton can be used to retain liquids, such as water resulting from melting ice, condensation, other liquids, and articles such as, for example, refuse, particulate matter, etc.

According to another aspect of the disclosure, a bottom receptacle of the carton can be constructed to have a height that extends above the bottom panel of the carton, below which there are no seams sealed by glue or other adhesives. The bottom receptacle may therefore be liquid-tight.

Other aspects, features, and details of the present disclosure can be more completely understood by reference to the following detailed description, taken in conjunction with the drawings and from the appended claims.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the disclosure.

FIG. 1 is a plan view of a blank used to form a carton according to a first embodiment of the disclosure.

FIG. 9 is a plan view of a blank used to form a carton according to a second embodiment of the disclosure.

Corresponding parts are designated by corresponding reference numbers throughout the drawings.

DETAILED DESCRIPTION OF THE EXEMPLARY EMBODIMENTS

Figure 2:
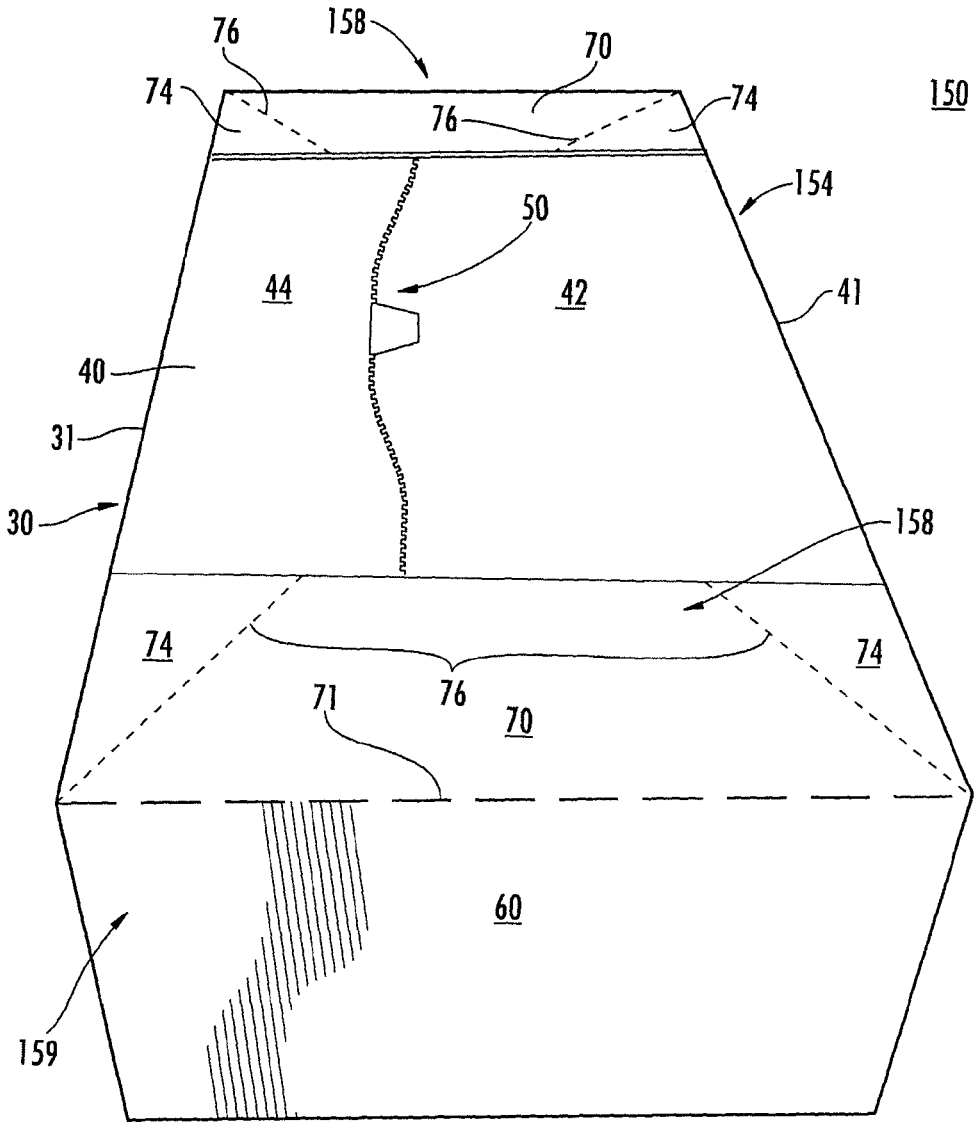
FIGS. 2-5 are perspective views of the erected carton according to the first embodiment illustrating the steps of opening an end of the carton.

The embodiments of the present disclosure described below generally relate to a carton suitable for storing and dispensing articles such as, for example, beverage containers. The carton provides a bottom receptacle suitable for accommodating, for example, liquids, ice, or other coolants in the carton bottom. In one exemplary embodiment, ice can be added to the opened top of the carton to cool beverage containers held within the carton. As the ice melts, all or a part of the resultant runoff water may be held within the bottom receptacle.

Articles accommodated within the present carton embodiments can include containers such as, for example, petaloid bottle beverage containers, metallic beverage cans, glass or plastic bottles, or other containers such as, for example, those used in packaging foodstuffs and other products. For the purposes of illustration and not for the purpose of limiting the scope of the disclosure, the following detailed description describes generally cylindrical metallic beverage containers as disposed within the carton. In this specification, the terms "side," "end," "bottom," and "top" indicate orientations determined in relation to fully erected, upright cartons.

FIG. 1 is a plan view of a blank 5 used to form a carton 150 (illustrated in FIG. 2) according to the first embodiment of the disclosure. The exterior or printed surface 3 of the blank 5 is shown in FIG. 1. The blank 5 has a longitudinal axis L1 extending along a length of the blank, and a lateral axis L2 extending along a width of the blank. The blank 5 may be symmetric or nearly symmetric about a transverse centerline $C_T$ and a longitudinal centerline $C_L$. Therefore, certain elements in the drawing figures may be indicated by identical or similar reference numerals in order to reflect the partial or complete symmetries in the blank 5.

The blank 5 comprises a bottom panel 10, first and second side panels 20 foldably connected to each side of the bottom panel 10 at longitudinal fold lines 21, respectively, a first top panel 30 foldably connected to the first side panel 20 at a longitudinal fold line 31, and a second top panel 40 foldably connected to the second side panel 20 at a longitudinal fold line 41. Adhesive 36 may be applied to the print or exterior surface 3 of the first top panel 30. A bottom end panel 60 is foldably connected to each end of the bottom panel 10 at a lateral fold line 61. A closure flap 70 is foldably connected to a distal end of each bottom end panel 60 at a lateral fold line 71. Adhesive 72 may be applied to the underside or interior surface of each closure flap 70. Corner flap portions 74 of the closure flaps 70 are defined at the distal corners of each closure flap 70 by breachable lines of disruption 76. Adhesive 78 may be applied to the underside of each corner flap portion 74. In this specification, the terms "end" and "side" are used for ease of reference, and do not imply relative sizes of the end panels 20 and the side panels 60, for example.

The second top panel 40 may include a breachable line of disruption 50 having a curved central portion 52 with an end portion 54 extending generally in the longitudinal direction L1 from each end of the central portion 52. In one embodiment, the breachable line of disruption 50 extends substantially across the entire length of the second top panel 40 and divides the second top panel into a first portion 42 and a second portion 44. An access feature 56 can be formed in the second top panel 40 at or adjacent to the breachable line of disruption 50. The access feature 56 can be defined, for example, by a breachable perimeter, or by an aperture in the second top panel 40.

A lower gusset 80 is located at each corner of the bottom panel 10, extending between and connected to an adjacent side panel 20 and bottom end panel 60. Each lower gusset 80 comprises a first gusset panel 82 foldably connected to a bottom end panel 60 at the longitudinal fold line 21, a second gusset panel 84 foldably connected to a side panel 20 at the lateral fold line 61 and the first gusset panel 82 at an oblique fold line 86.

In one embodiment, upper gussets 88 are adjacent a respective one of the lower gussets 80. In the embodiment of FIG. 1, the upper gussets 88 each comprise a third gusset panel 90 and a fourth gusset panel 92. Each third gusset panel 90 is foldably connected to the second gusset panel 84 at one of the longitudinal fold lines 31, 41. Each of the fourth gusset panels 92 is respectively foldably connected to one of the top panels 30, 40 at a respective longitudinal fold line 61 and the third gusset panel 90 at an oblique fold line 94.

In the exemplary illustrated embodiment, the fold lines 21, 86 are crease lines, and the fold lines 31, 41, 71, 94 are cut-crease lines. The fold lines 61 are crease lines at the panels 10, 20 and terminate at cut-crease lines at the panels 30, 40. In one embodiment, the breachable lines of disruption 50, 76 are tear lines. The crease lines, fold lines, tear lines, or other lines illustrated and described herein could be modified to be other lines of disruption without departing from the scope of this disclosure.

An exemplary method of erecting the carton 150 from the blank 5 is discussed below with reference to FIGS. 1 and 2. The carton 150 can be erected with other methods or folding steps without departing from the disclosure.

Referring to FIGS. 1 and 2, the blank 5 is folded flat about the longitudinal fold line 21 (the fold line 21 to the right in FIG. 1) and the fold line 31 and the interior surface of the second top panel 40 is adhered to the print or exterior surface of the first top panel 30 by the adhesive 36. The partially erected blank may then be opened up into a generally tubular form or sleeve having open ends. The carton 150 may be filled with articles such as, for example, generally cylindrical beverage containers C (illustrated in FIG. 5) before closing one or both ends of the carton. From the tubular, open-ended carton form, the first and second gusset panels 82, 84 are folded inwardly with respect to each other about the oblique fold lines 86, while the third and fourth gusset panels 90, 92 are folded with respect to one another about the oblique fold lines 94. Each bottom end panel 60, and its attached closure flap 70, is folded upwardly about a respective longitudinal fold line 61 until it is generally upright. The interior surface of each closure flap 70 is then adhered to a respective adjacent exterior surface of a third gusset panel 90 by the adhesive 72 (the relationship between the panels 70, 90 is generally shown in a partially unassembled configuration in FIG. 4). The closure flaps 70, with the third gusset panels 90 adhered thereto, are then folded about the fold lines 71 so that they lie against the top of the second top panel 40. The interior surfaces of the corner flap portions 74 at the corners of the closure flap 70 are adhered to the second top panel 40 by the adhesive 78. As the closure flaps 70 are folded over, the third and fourth gusset panels 90, 92 are folded over so that the interior surfaces of the third and fourth gusset panels 90, 92 are in generally face-to-face contact and they overlie the second top panel 40, beneath a respective closure flap 70. As shown in FIG. 6, the third gusset panel 90 generally overlays and extends from the fourth gusset panel 92 so that a portion of the interior surface of the third gusset panel is in face-to-face contact with the second top panel 40. The exterior surface of the fourth gusset panel 92 is in face-to-face contact with the second top panel 40.

FIG. 2 illustrates the carton 150 erected from the blank 5. In the illustrated embodiment, the carton 150 is loaded with eighteen generally cylindrical twelve-ounce beverage containers C disposed in a 6×3×1 configuration. Embodiments with alternative configurations are considered within the scope of the present disclosure. The carton 150 has a generally parallelepipedal shape with the first and second top panels 30, 40 forming a top wall 154 closing a top end of the carton 150. At each end of the carton 150, the closure flap 70, the third gusset panels 90 adhered to the underside of the closure flap 70, and the fourth gusset panels 92 connected to the third gusset panels 90 form a top end closure 158. Each of the bottom end panels 60 with the respective adjacent lower gussets 80 and the respective adjacent top end closure 158 cooperate to form end walls 159.

An exemplary method of opening and placing the carton 150 in a first dispensing configuration is discussed below with reference to FIGS. 2-8.

Figure 3:
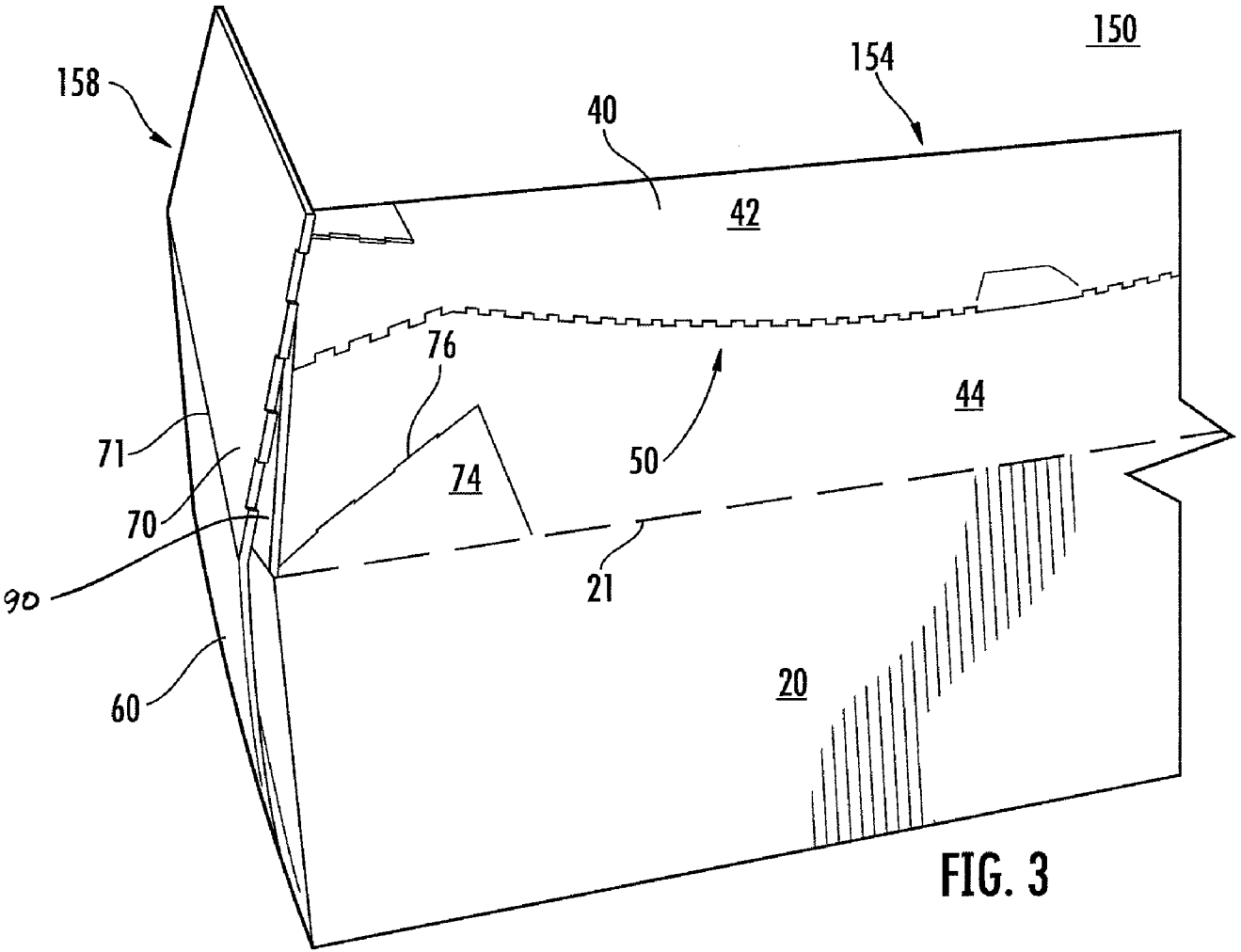

Referring to FIG. 3, to begin opening of one end of the carton 150, a top end closure 158 is pivoted upwardly by grasping the top end closure 158 and tearing the closure flap 70 at the oblique tear lines 76. The corner flap portions 74 at the corners of the closure flap 70 remain adhered to the second top panel 40 by the adhesive 78. The remainder of the top end closure 158, including the remainder of the closure flap 70 and the upper gussets 88, separates from the second top panel 40.

Figure 4:
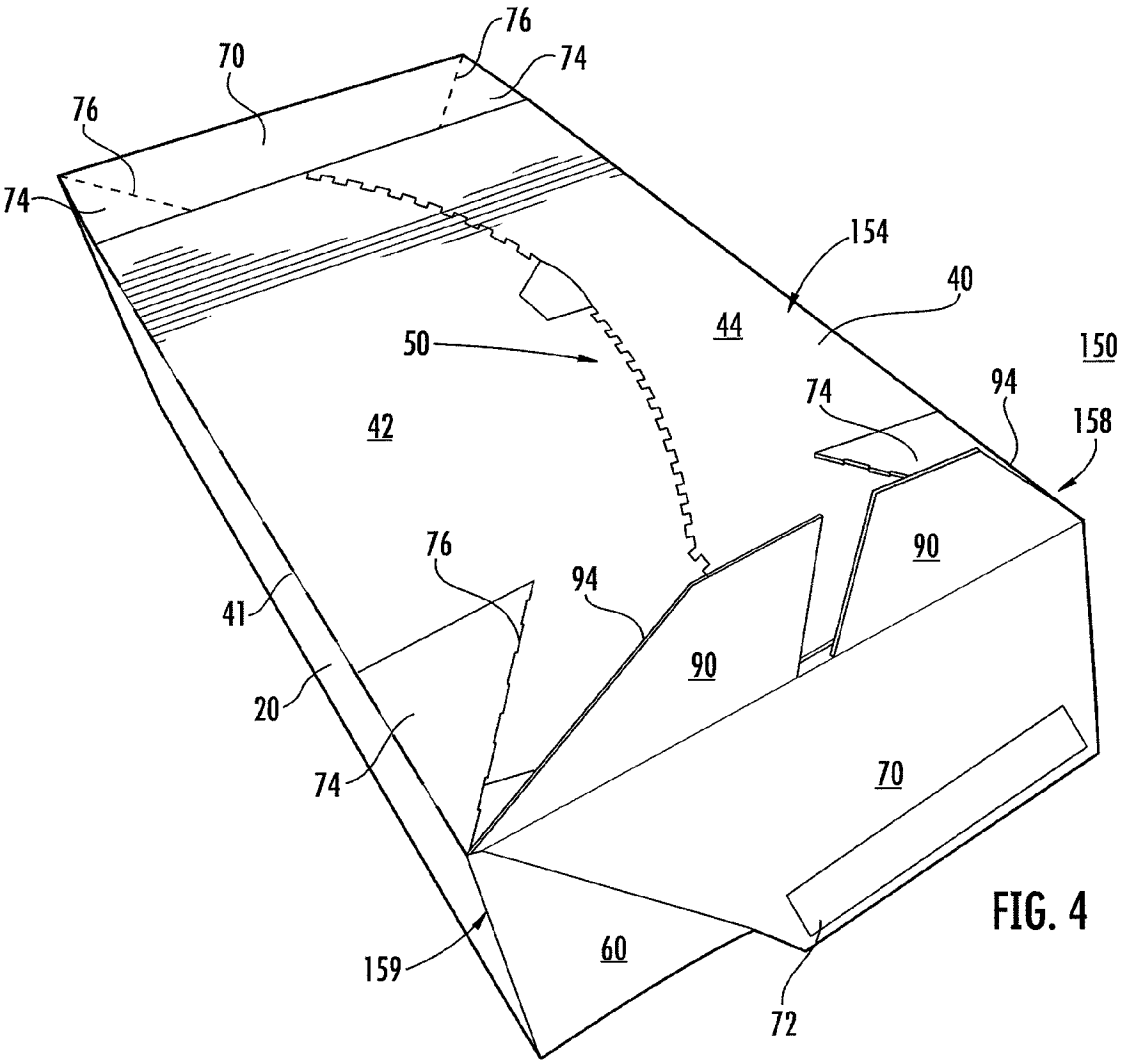

Referring to FIG. 4, the closure flap 70 is separated from the third gusset panels 90. The closure flap 70 may be separated from the third gusset panels 90 by tearing the panels against the adhesive holding them together. Alternatively, in a particular embodiment, the closure flap 70 may include one or more further breachable lines of disruption (not shown) to allow easier separation of the panels.

Figure 5:
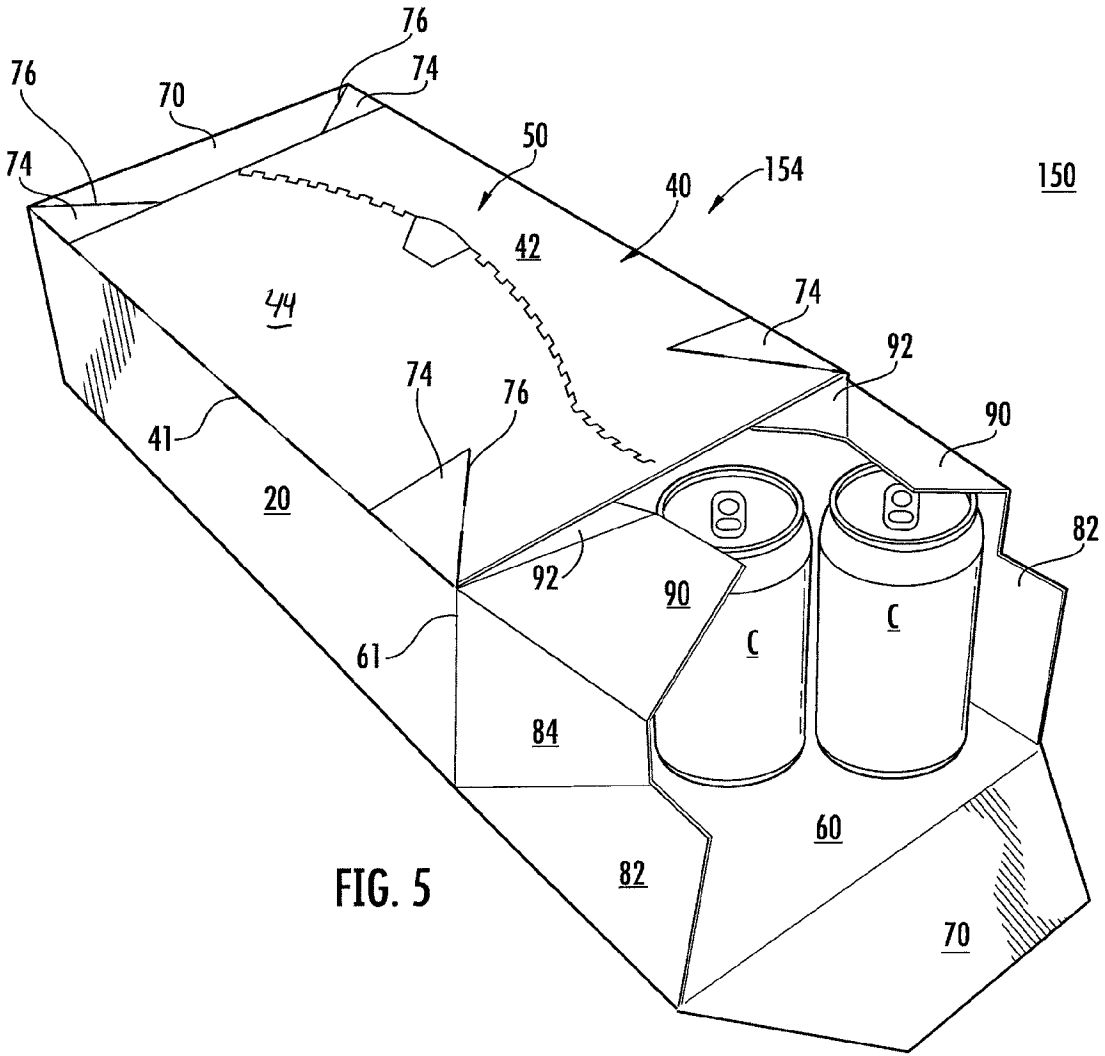
Figure 6:
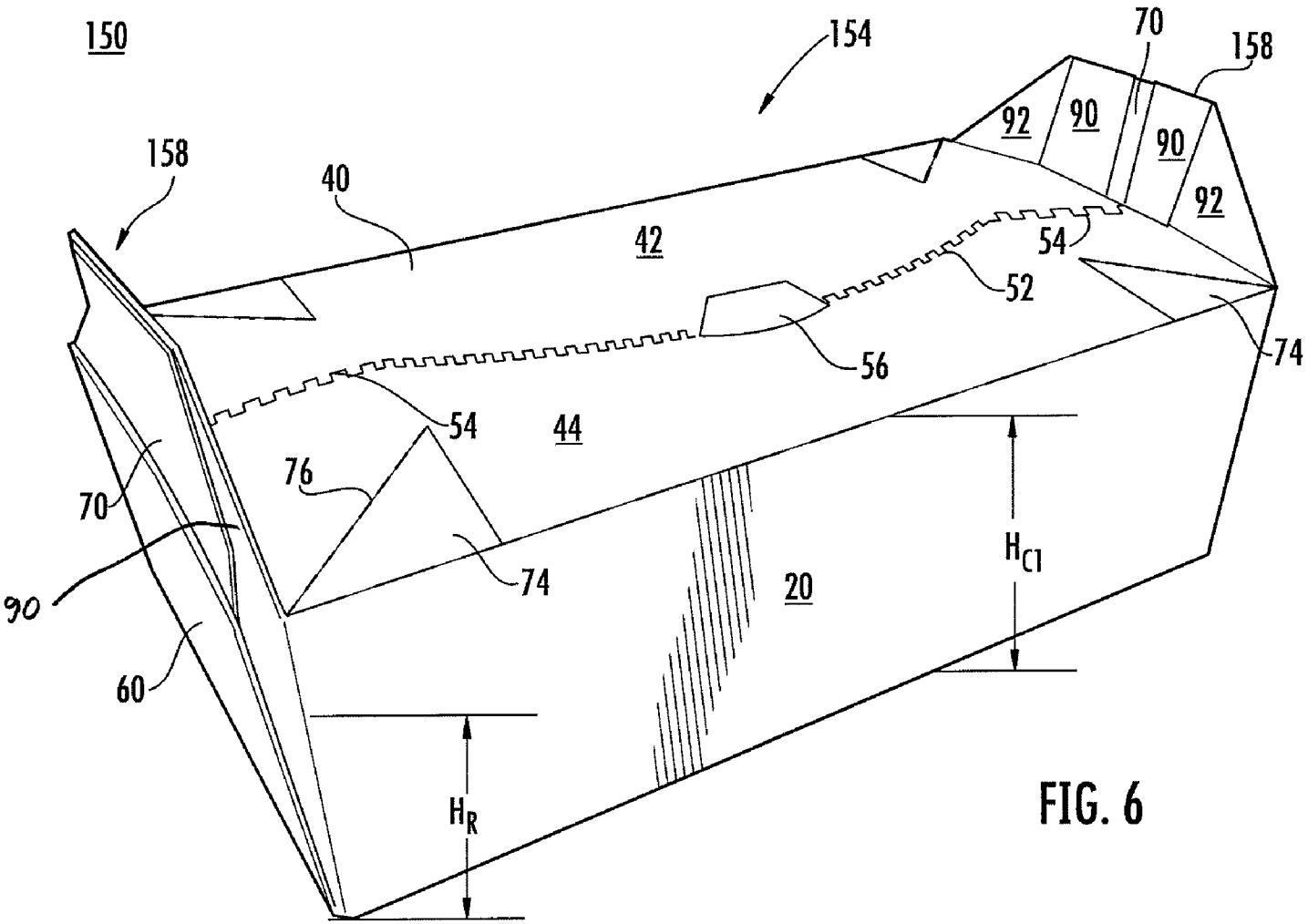
FIGS. 6-8 are perspective views of the erected carton of FIG. 2 illustrating the steps of opening the top of the carton.

Referring to FIG. 5, the end of the carton 150 can be opened by pivoting the end panel 60 downwardly so that the gusset panels 82, 84, 90, 92 expand outwardly. Containers C accommodated within the carton 150 can now be accessed through the resultant end opening. The opposite end of the carton 150 can be opened in a similar manner.

An exemplary method of opening and placing the carton 150 in a second, expanded dispensing configuration is discussed below with reference to FIGS. 3 and 6-8.

To place the carton 150 in the second dispensing configuration, a first end closure 158 is breached at the tear lines 76 in the closure flap 70 and pivoted upwardly as shown in FIG. 3.

Referring to FIG. 6, the second end closure 158 at the opposite end of the carton 150 is pivoted upwardly, tearing the closure flap 70 at the oblique tear lines 76.

Figure 7:
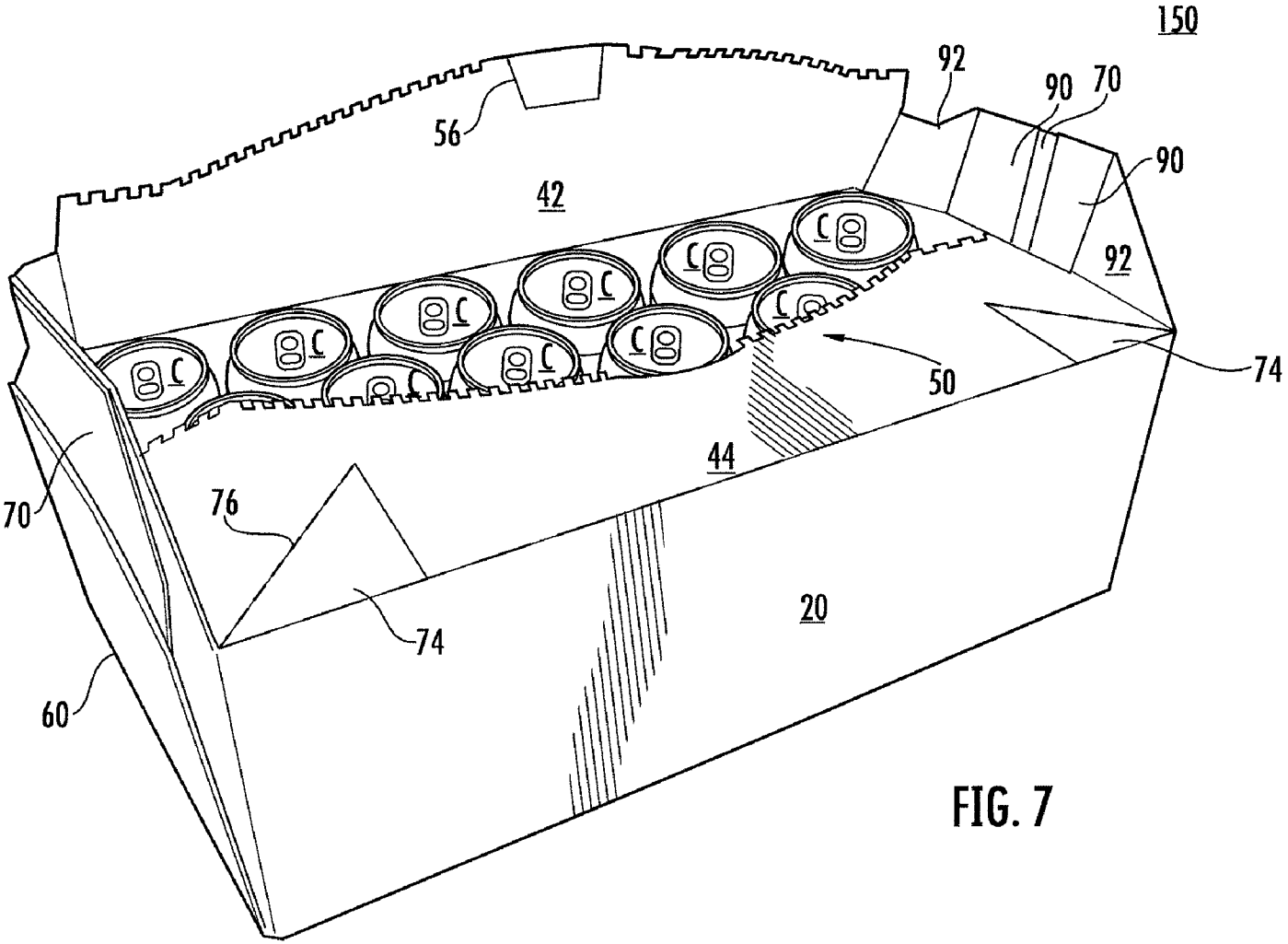

Referring to FIG. 7, the top wall 154 is breached at the line of disruption 50 in the second top panel 40. Breaching of the top wall 154 can be initiated at the access feature 56 and the top panel 40 torn along the line of disruption 50 until the first and second portions 42, 44 are separated from one another. The first and second portions 42, 44 can then be pivoted upwardly away from one another.

Figure 8:
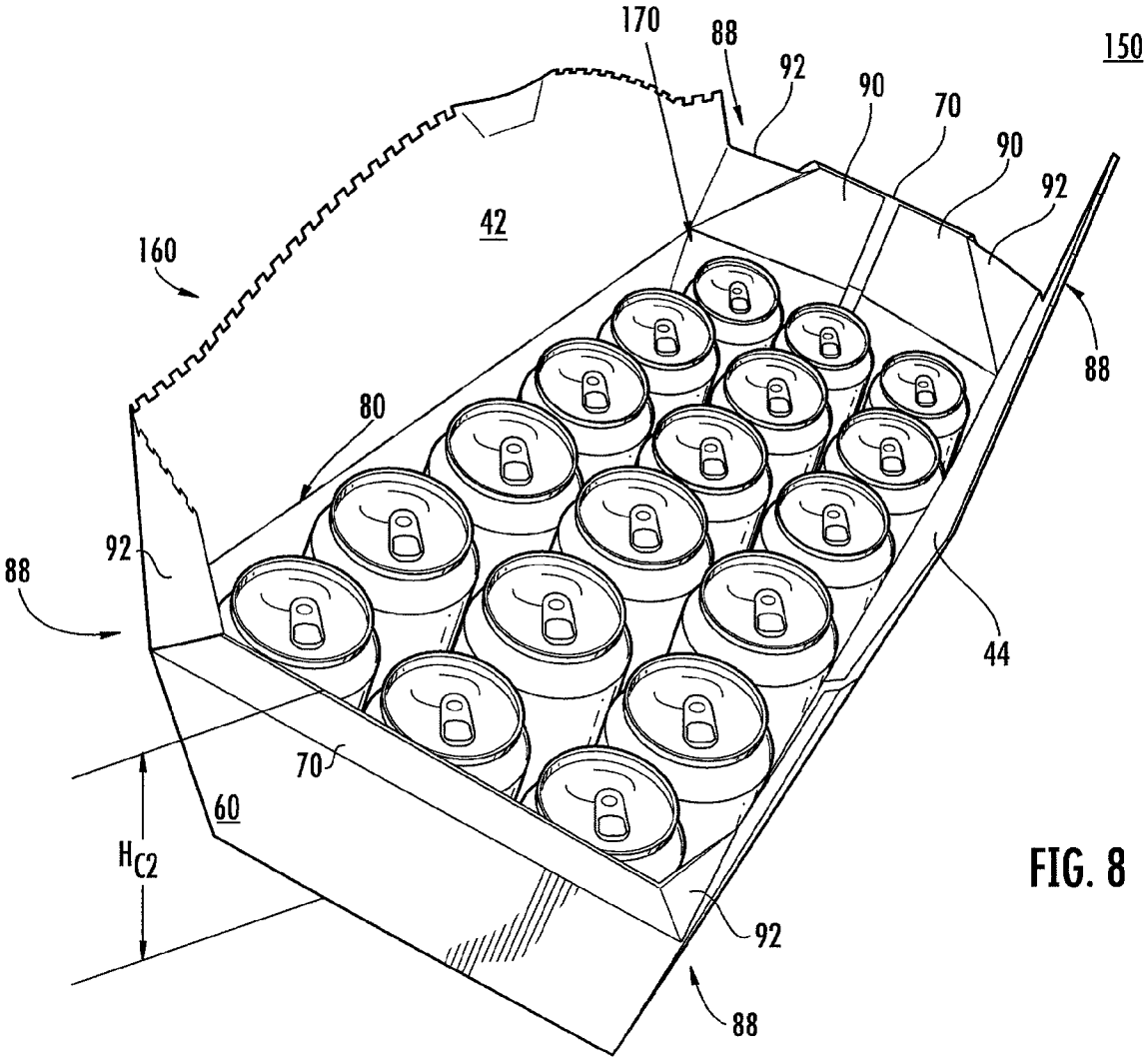

Referring to FIG. 8, the first and second portions 42, 44 are separated from one another and are pivoted upwardly to place the carton 150 in an expanded, second dispensing configuration. The upper gussets 88 at each corner of the carton 150 open up as the portions 42, 44 are pivoted upwardly. The upper gussets 88, the first and second portions 42, 44 of the top panel 40, and the closure flaps 70 form an upright extension 160 or "chimney" that extends above the height of the side panels 20 and the end panels 60.

In the expanded configuration, the containers C can be accessed from the opening 160 in the top of the carton 150. In addition, ice, cool water, or other coolant means, for example, may be introduced into the interior volume of the carton 150 so that it contacts the containers C. A first height $H_{C1}$ of the carton 150 is shown in FIG. 6 as generally conforming to the height of the side panels 20. A second height $H_{C2}$ indicates the height of the interior volume of the carton 150 when the carton is in the expanded configuration of FIG. 8 (i.e., the height of the bottom end panel 60 and the closure flap 70 that extends upwardly from the bottom end panel 60). The upright extension 160 provides a portion of the carton 150 with minimal glued seals or seams through which water or other liquid might leak. The upper gussets 88 extend upwardly from the bottom end panel 60 and side panels 20 at respective corners of the opened carton 150 to provide sealed corners of the opened cartons. The sealed corners provide a substantially liquid-tight or liquid resistant corner that is above bottom end panel 60 to provide usable volume of the carton 150.

According to one aspect of the present disclosure, the added interior volume afforded by increasing the carton height to the second height $H_{C2}$ can be used to accommodate a significant volume of cooling media such as, for example, ice. If desired, additional articles may be placed in the carton 150 after opening. For example, if the containers C are beverage containers, ice may be placed over the containers C and held within the carton interior to cool the containers. As the ice melts, the carton 150 serves to retain all or a portion of the water runoff from the melting ice.

According to one embodiment of the present disclosure, the height of the interior volume of the carton 150 increases by at least 10% when changed from the closed configuration illustrated in FIG. 6, having height $H_{C1}$, to the open and expanded configuration shown in FIG. 8, having height $H_{C2}$. According to another embodiment of the disclosure, the second height $H_{C2}$ is at least 25% greater than the first height $H_{C1}$. Alternative configurations having different ratios between the height $H_{C1}$ and the height $H_{C2}$ are considered within the scope of this disclosure.

Referring to FIGS. 1, 6, and 8, the lower gussets 80 may define in part an at least partially liquid-tight bottom receptacle 170 in the erected carton 150. The height $H_R$ of the top edge or upper border of the bottom receptacle 170 is shown in FIG. 6 and represents a portion of the bottom of the carton 150 below which no glued seals or seams are formed through which water or other liquid might leak. That is, no adhesive seal or other joinder of material where fluid might escape the carton 150 is located in the carton at a position below the top edge of the bottom receptacle 170. The bottom receptacle 170 may therefore be formed from a continuous portion of folded material of the blank 5. The height $H_R$ may correspond to, for example, the height to which the top point 180 (FIG. 1) of the oblique fold lines 86 of the lower gussets 80. The height $H_R$ may be, for example, defined as a function of a height of the carton 150. For example, the bottom receptacle 170 may define a liquid-tight portion having a height $H_R$ that is at least about 20% of the height $H_{C1}$ of the carton 150. In another embodiment, the receptacle 170 height $H_R$ may be at least about 40% of a height $H_{C1}$ of the carton 150. The receptacle height $H_R$ may be increased or decreased, for example, to accommodate larger or smaller anticipated liquid volumes in the carton 150.

The blank 5 can, for example, be constructed of water resistant material to any degree desired so that liquid in the bottom of the carton 150 remains in the carton 150 for a selected amount of time.

FIG. 9 is a plan view of an exterior surface 203 of a blank 205 used to form a carton (not illustrated) according to a second embodiment of the disclosure. The exterior or printed surface of the blank 205 is shown in FIG. 9. The blank 205 may be symmetric or nearly symmetric about a transverse centerline $C_T$ and a longitudinal centerline $C_L$. Therefore, certain elements in the drawing figures may be indicated by identical or similar reference numerals in order to reflect the partial or complete symmetries in the blank 205.

The blank 205 illustrated in FIG. 9 is similar to the blank 5 shown in FIG. 1, with like or similar elements or features from FIG. 1 being preceded by a "2" in the embodiment of FIG. 9. In FIG. 9, the tear line 250 used to open the top panel of the carton extends substantially straight, in the longitudinal direction L1, across the second top panel 240. The blank 205 can be formed into a carton in a manner similar to the blank 5, and the resultant carton can be placed into an expanded configuration as discussed above with reference to FIGS. 6-8.

Figure 10:
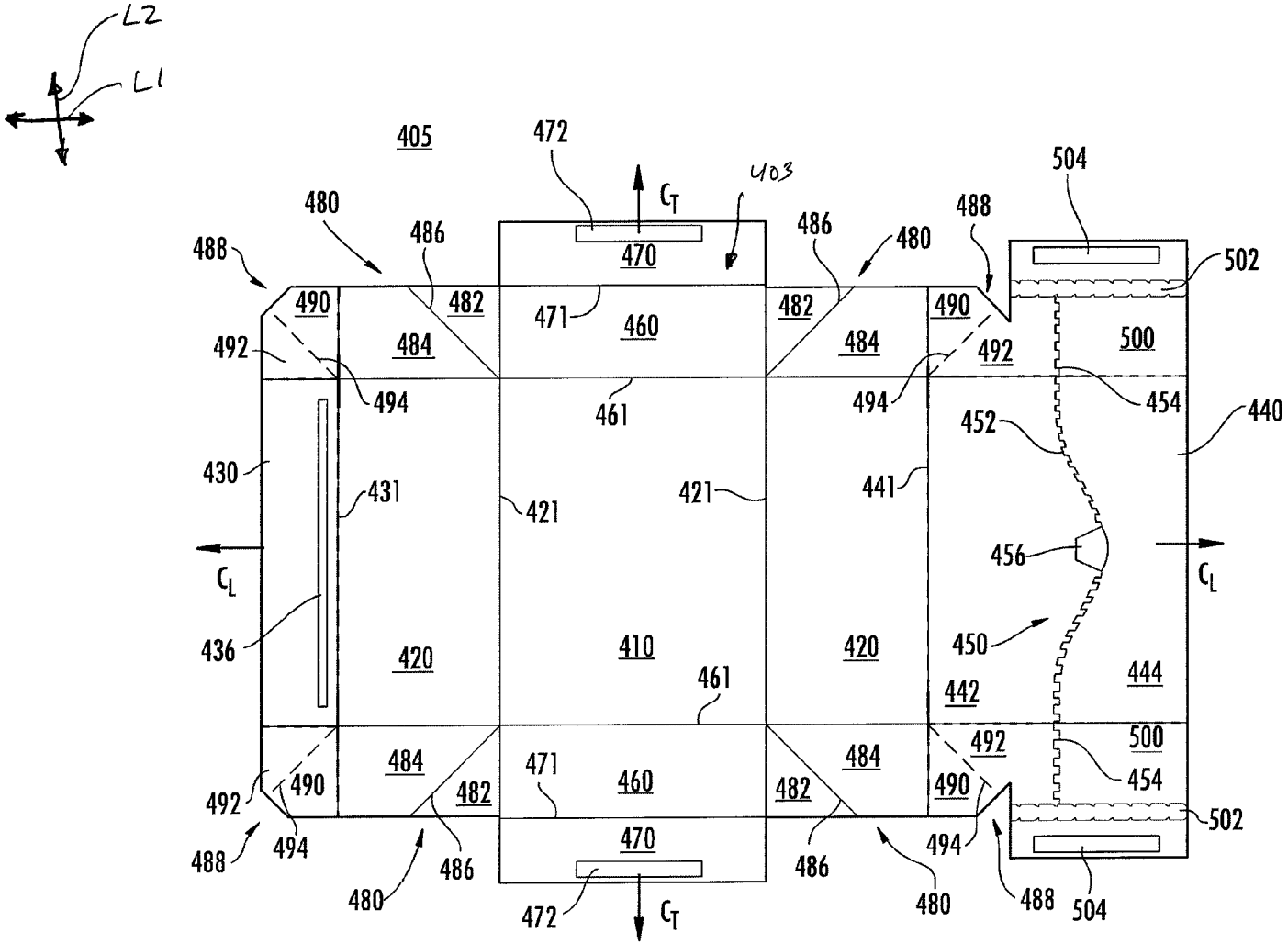
FIG. 10 is a plan view of a blank used to form a carton according to a third embodiment of the disclosure.

FIG. 10 is a plan view of a blank 405 used to form a carton 550 according to a third embodiment of the disclosure. The blank 405 may be symmetric or nearly symmetric about a transverse centerline $C_T$ and a longitudinal centerline $C_L$.

Therefore, certain elements in the drawing figures may be indicated by identical or similar reference numerals in order to reflect the partial or complete symmetries in the blank 405. The blank 405 has similar or identical features as the blank 5 of the first embodiment, with like or similar features being designated with like or similar reference numbers in the third embodiment. At least some of the like or similar features between the first and third embodiments have been designated with similar reference numbers that are preceded by a "4" in the third embodiment.

In the third embodiment, the blank 405 comprises a bottom panel 410, first and second side panels 420 connected to the bottom panel 410 at lateral fold lines 421, a first top panel 430 foldably connected to the first side panel 420 at a lateral fold line 431, and a second top panel 440 foldably connected to the second side panel 420 at a lateral fold line 441. A bottom end panel 460 is foldably connected to each end of the bottom panel 410 at longitudinal fold lines 461. A closure flap 470 is foldably connected to a distal end of each bottom end panel 460 at longitudinal fold lines 471. The terms "end" and "side" are used for ease of reference, and do not imply relative sizes of the bottom end panels 460 and the side panels 420, for example.

The second top panel 440 may include a breachable line of disruption 450 having a curved central portion 452 with an end portion 454 extending from each end of the central portion 452. The breachable line of disruption 450 divides the second top panel 440 into a first portion 442 and a second portion 444. An access feature 456 can be formed in the second top panel 440 at or adjacent to the breachable line of disruption 450 to provide access thereto. The access feature 456 can be defined, for example, by a breachable perimeter, or by an aperture in the second top panel 440. In an alternative embodiment, the breachable line of disruption 450 is a straight line similar to the breachable line of disruption 250 in FIG. 9.

A lower gusset 480 is located at each corner of the bottom panel 410, extending between and connected to an adjacent side panel 420 and an adjacent bottom end panel 460. Each lower gusset 480 comprises a first gusset panel 482 foldably connected to a bottom end panel 460 at a fold line 421, and a second gusset panel 484 foldably connected to the first gusset panel 482 at an oblique fold line 486. The second gusset panel 484 is also foldably connected to an adjacent side panel 420 at a fold line 461. Upper gussets 488 include a third gusset panel 490 foldably connected to the second gusset panel 484 at a fold line 431 or 441 and a fourth gusset panel 492 foldably connected to the third gusset panel 490 at an oblique fold line 494. The fourth gusset panel 492 is also connected to the top panel 430 or 440 at a fold line 461.

In the third embodiment, top end flaps 500 are foldably connected to each end of the second top panel 440 and are connected to an adjacent fourth gusset panel 492. A longitudinally extending tear strip 502 is formed in each top end flap 500. Each of the end portions 454 of the breachable line of disruption 450 respectively extends from the second top panel 440 (e.g., from longitudinal fold line 461) to a respective one of the longitudinal tear strips 502.

An exemplary method of erecting the carton 450 from the blank 405 is discussed below with reference to FIGS. 11-13.

Figure 11:
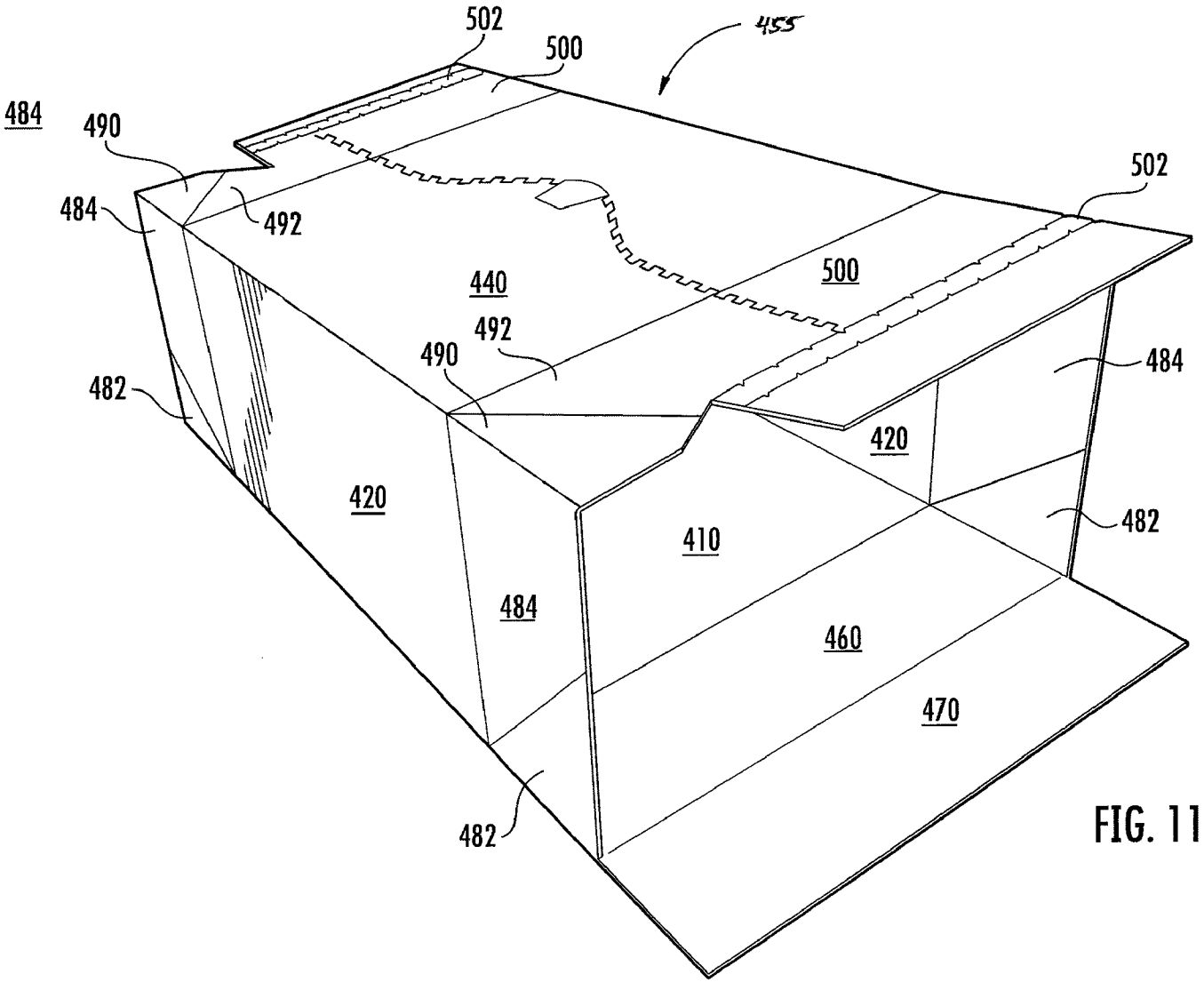
FIGS. 11-14 are perspective views illustrating the steps of erecting the blank of FIG. 10 into a carton.

Referring to FIG. 11, the blank 405 is folded flat by folding about transverse fold line 421 (fold line 421 on the right in FIG. 10) and the transverse fold line 431 so that the interior surface of the second top panel 440 may be adhered to the print or exterior surface of the first top panel 430 by an adhesive strip 436. The fourth gusset panels 492 connected to the first top panel 430 can be adhered to the interior surface of the respective top end flap 500. The partially erected blank may then be opened up by folding along transverse fold lines 421, 431, 441 to form a generally tubular form with open ends (e.g., sleeve 455) as shown in FIG. 11.

Figure 12:
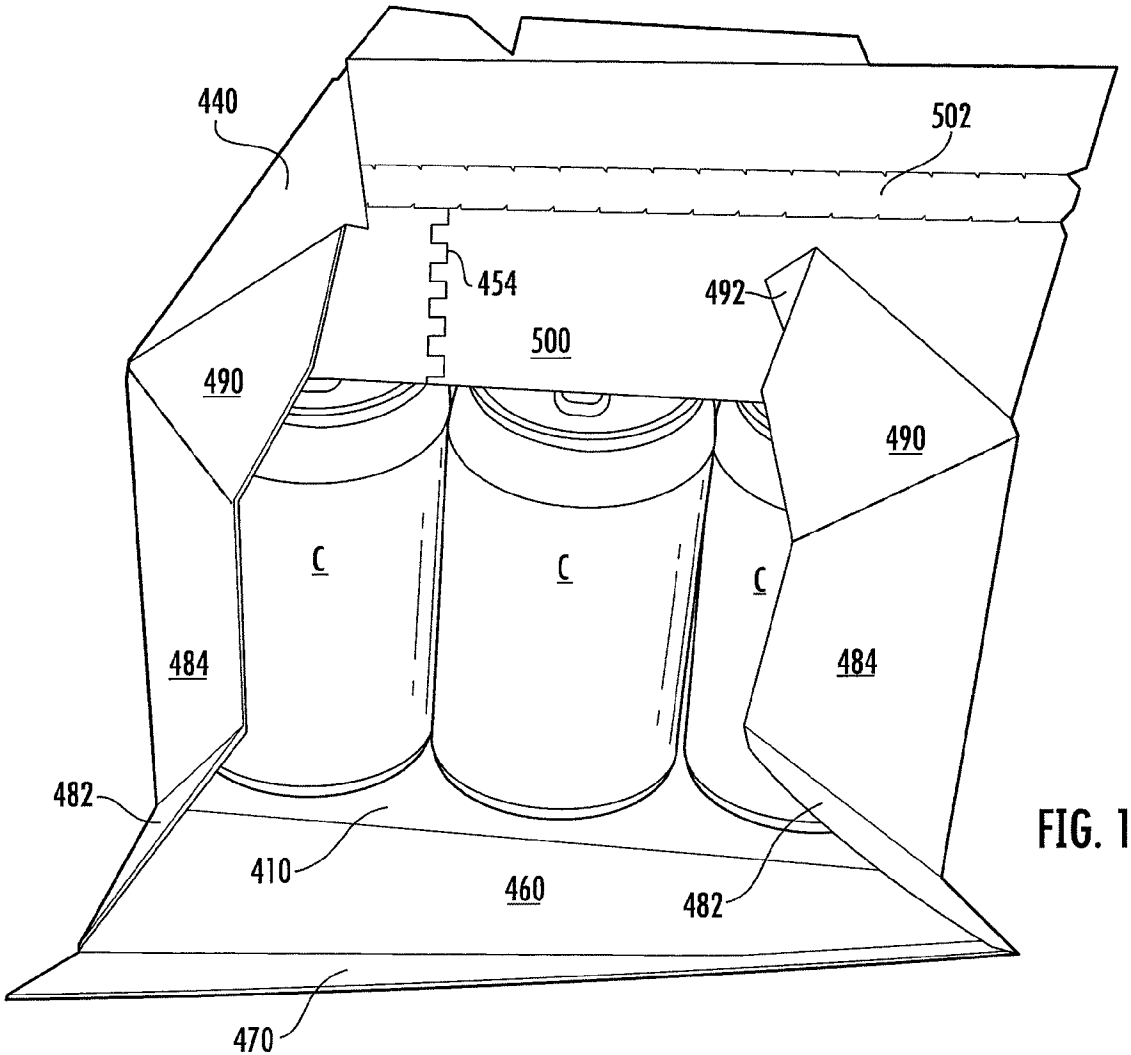
Figure 13:
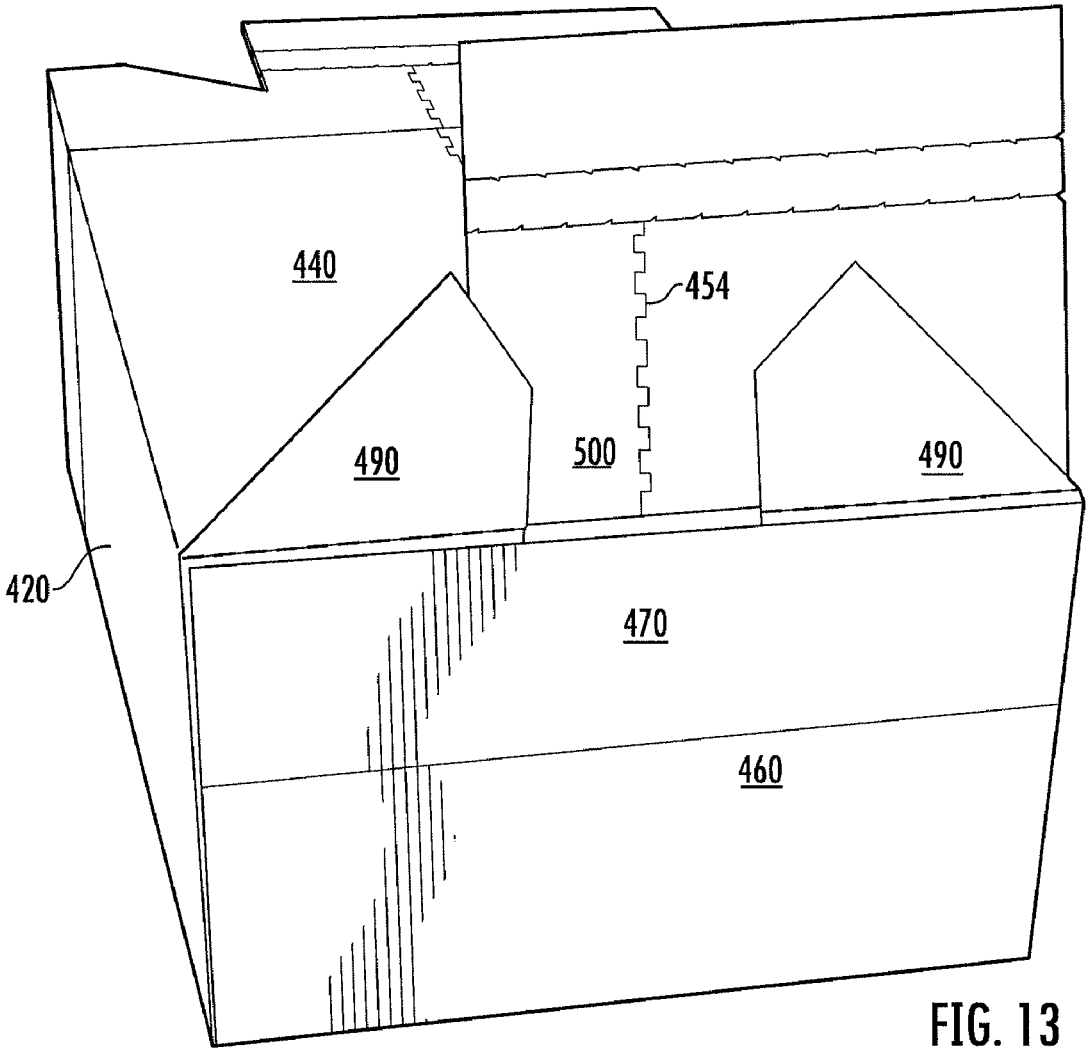

Referring to FIGS. 11-13, the ends of the partially erected carton 455 may be closed by the panels or flaps 460, 470, 482, 484, 490, 492, 496, 500 using adhesive 472, 504. More particularly, at each end, the first and second gusset panels 482, 484 are folded about the oblique fold lines 486 and the bottom end panel 460 is folded upward about fold line 461 until each first gusset panel 482 is in face-to-face contact with a respective second gusset panel 484 and the bottom end panel 460 and the closure flap 470 are substantially perpendicular to the bottom panel 410. Further, the upper gussets 488 are folded about the oblique fold lines 494 so that each third gusset panel 490 is in face-to-face contact with a respective fourth gusset panel 492, as shown in FIG. 13. The closure flap 470 can be glued to the print side of the second gusset panels 484 with adhesive 472. Folding the top end flap 500 and the upper gussets 490 downward about the fold lines 431, 441, 461 places the top end flap 500 and the fourth gusset panels 490 in face-to-face contact with the bottom end panel 460 and the closure flap 470 and forms end walls 559, shown in FIG. 14. The underside of top end flap 500 is glued to the print side of the bottom end panel 460 with adhesive 504. In a particular embodiment, the fourth gusset flaps 490 may be longer than shown in the figures so that they overlap to further contain cooling material in the carton 550.

The partially erected blank may be filled with articles such as, for example, generally cylindrical beverage containers C before closing one or both ends of the generally tubular form.

Figure 14:
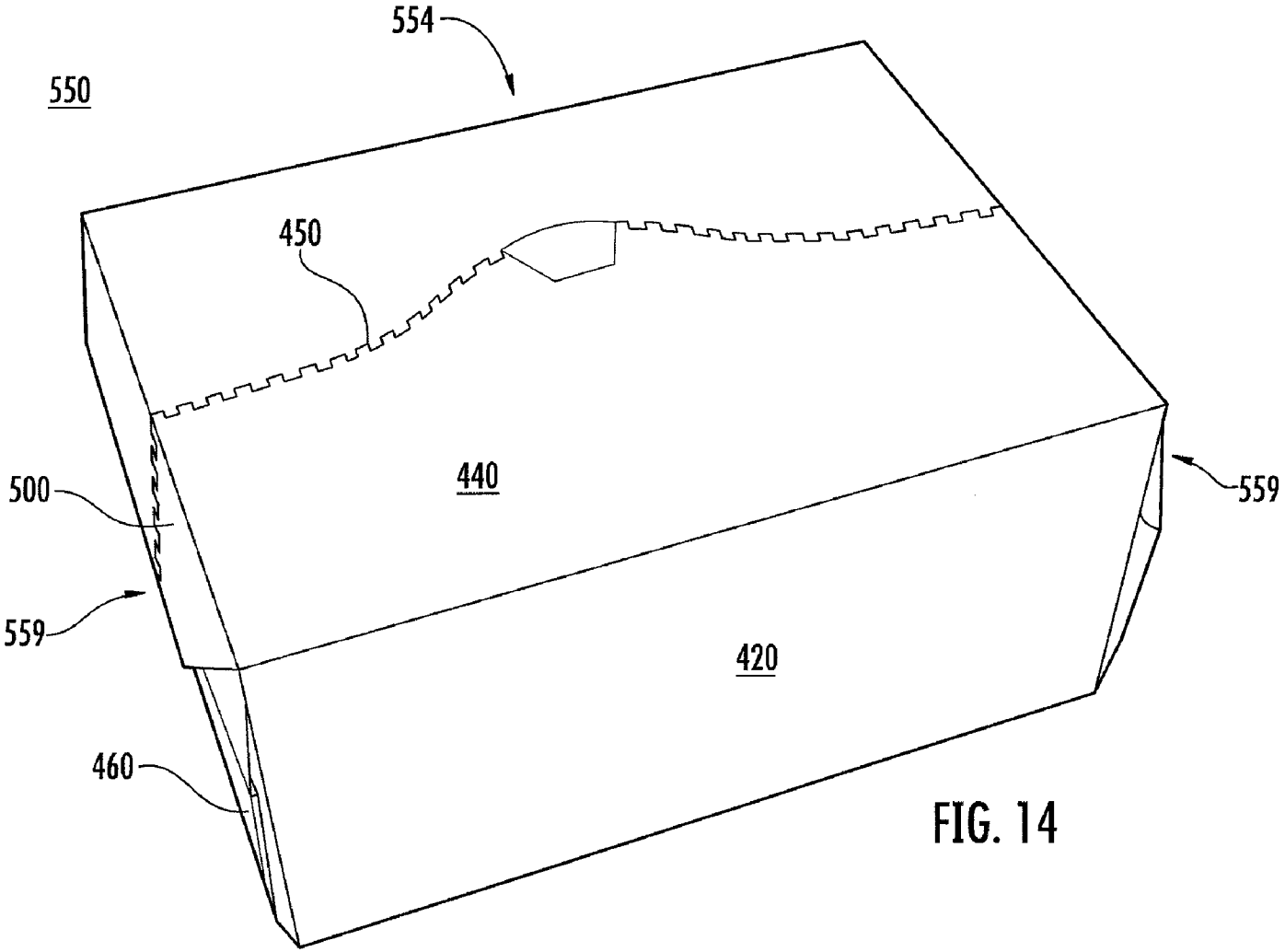

FIG. 14 illustrates the carton 550 erected from the blank 405. In the illustrated embodiment, the carton 550 is loaded with twelve generally cylindrical twelve-ounce beverage containers C disposed in a 4×3×1 configuration. Embodiments with alternative configurations are considered within the scope of the present disclosure. The carton 550 has a generally parallelepipedal shape with the first and second top panels 430, 440 forming a top wall 554 closing a top end of the carton 550. Each of the bottom end panels 460 with the respective adjacent lower gussets 480 and the respective adjacent top end flap 500 and upper gussets 488 cooperate to form end walls 559.

An exemplary method of opening the carton 550 and placing the carton into a dispensing configuration is discussed below with reference to FIGS. 15-18.

Figure 15:
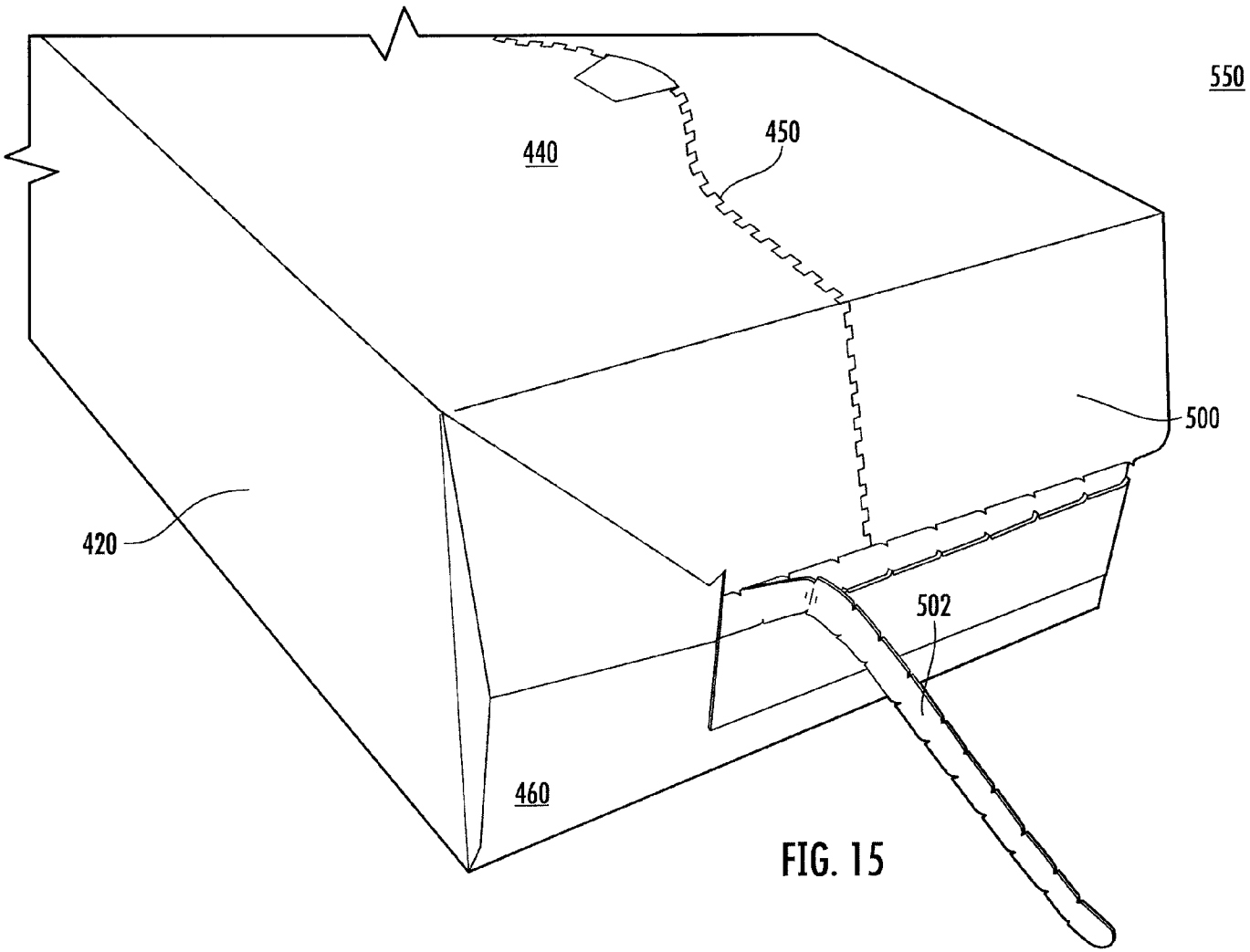
FIG. 15-18 are perspective views of the carton of FIG. 14 illustrating the steps of opening the top of the carton.
Figure 16:
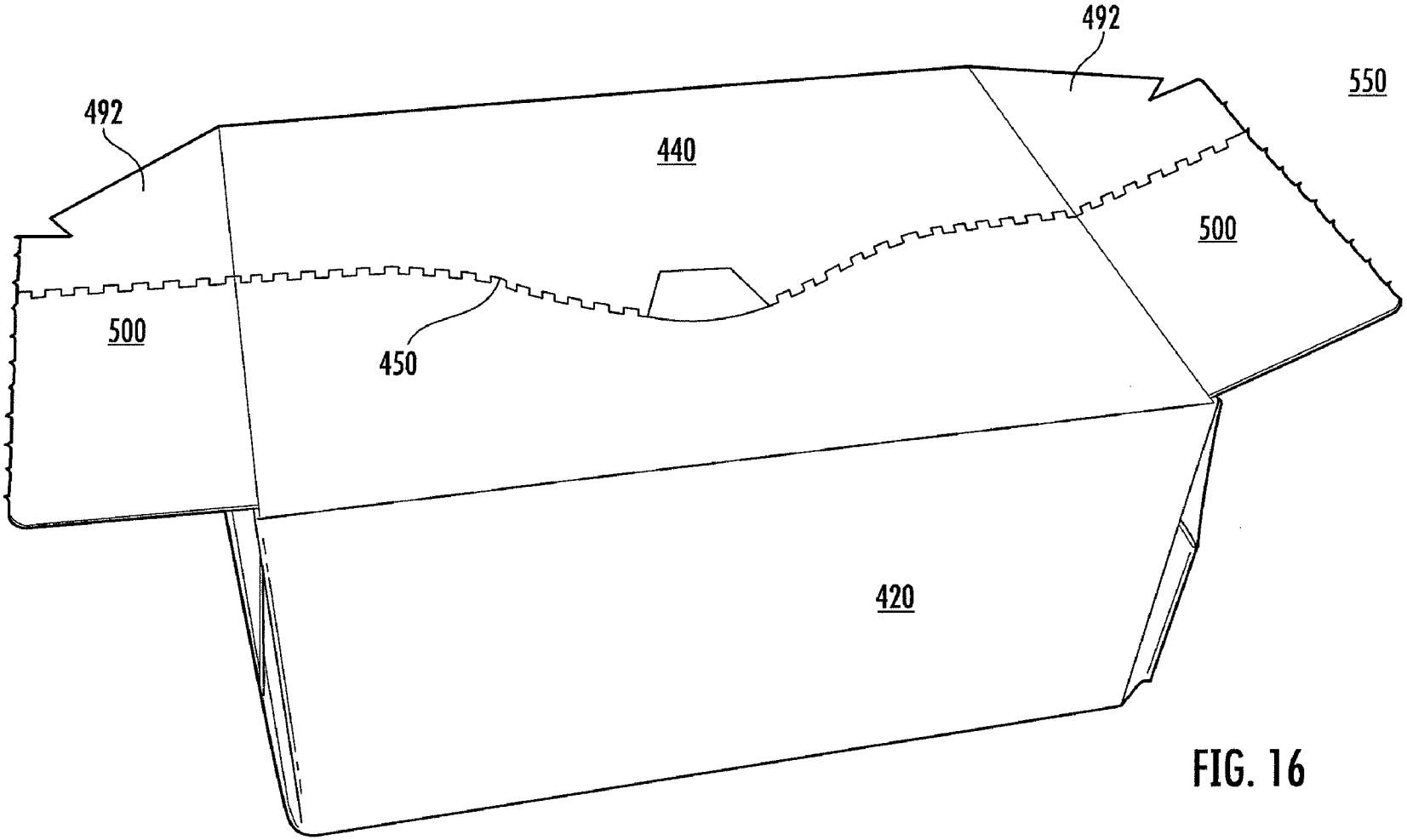

Referring to FIGS. 15-16, each end of the carton 550 is initially breached by tearing off each of the tear strips 502. The top end flaps 500 and the adjacent upper gusset panels 488 can then be turned away from the bottom end panels 460 and the closure flaps 470, folding about the fold lines 431, 441, 461. The portion of the top end flaps 500 with adhesive 504 can remain attached to the respective bottom end panels 460.

Figure 17:
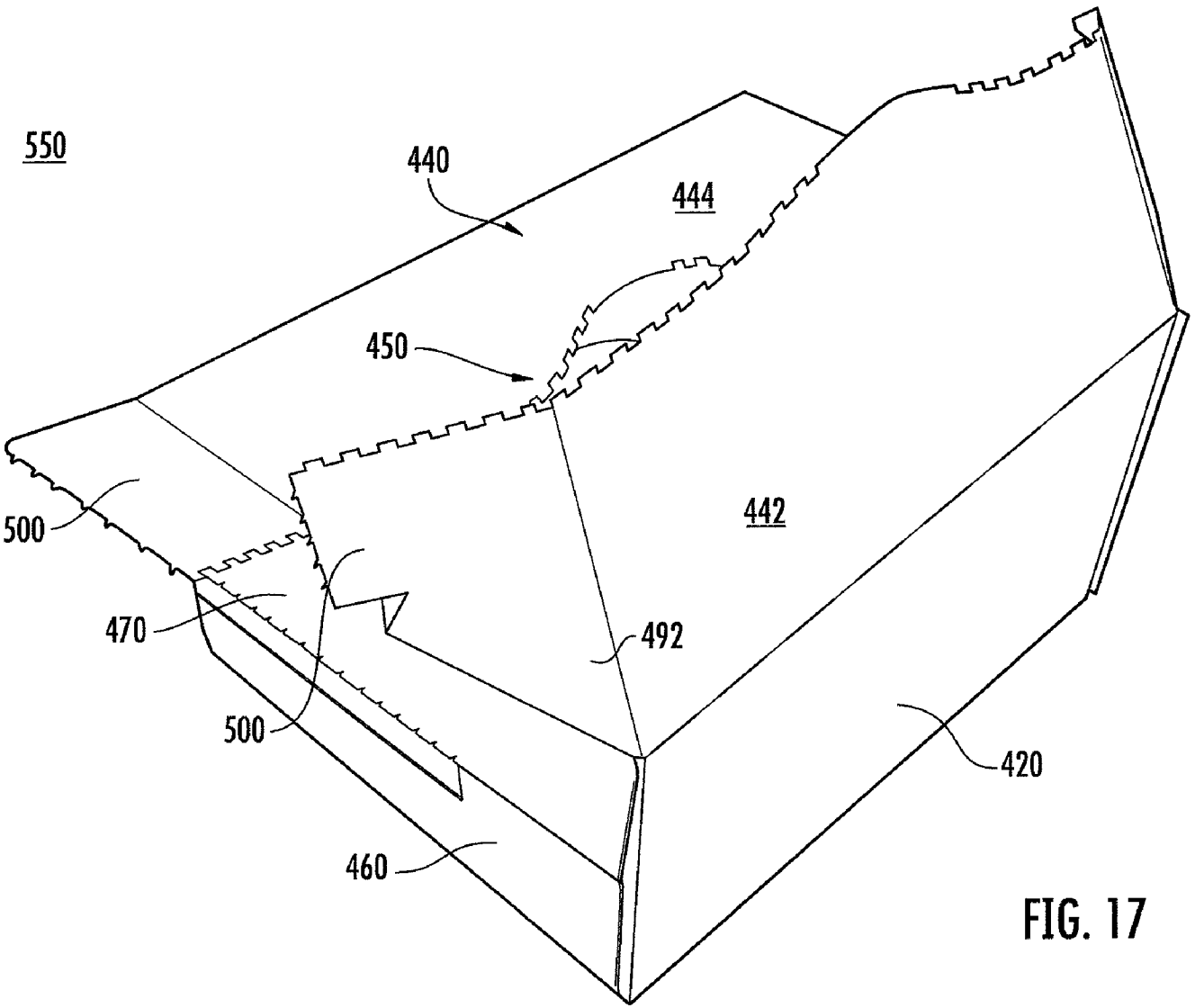

Referring to FIG. 17, the second top panel 440 is breached at the breachable line of disruption 450 so that the second top panel 440 is separated into the first and second portions 442, 444. The portions 442, 444 may then be pivoted upwardly, expanding the upper gussets 488 and placing the carton 550 in a dispensing configuration. The upper gussets 488 and the top panels 430, 440 form an upright extension 560 that extends above the height of the side panels 420 and the end walls 559. The upright extension 560 provides additional support for cooling material placed over the containers C in the carton 550. The upright extension or opening 560 in the top of the carton 550 provides access to the containers C accommodated within the carton interior.

Figure 18:
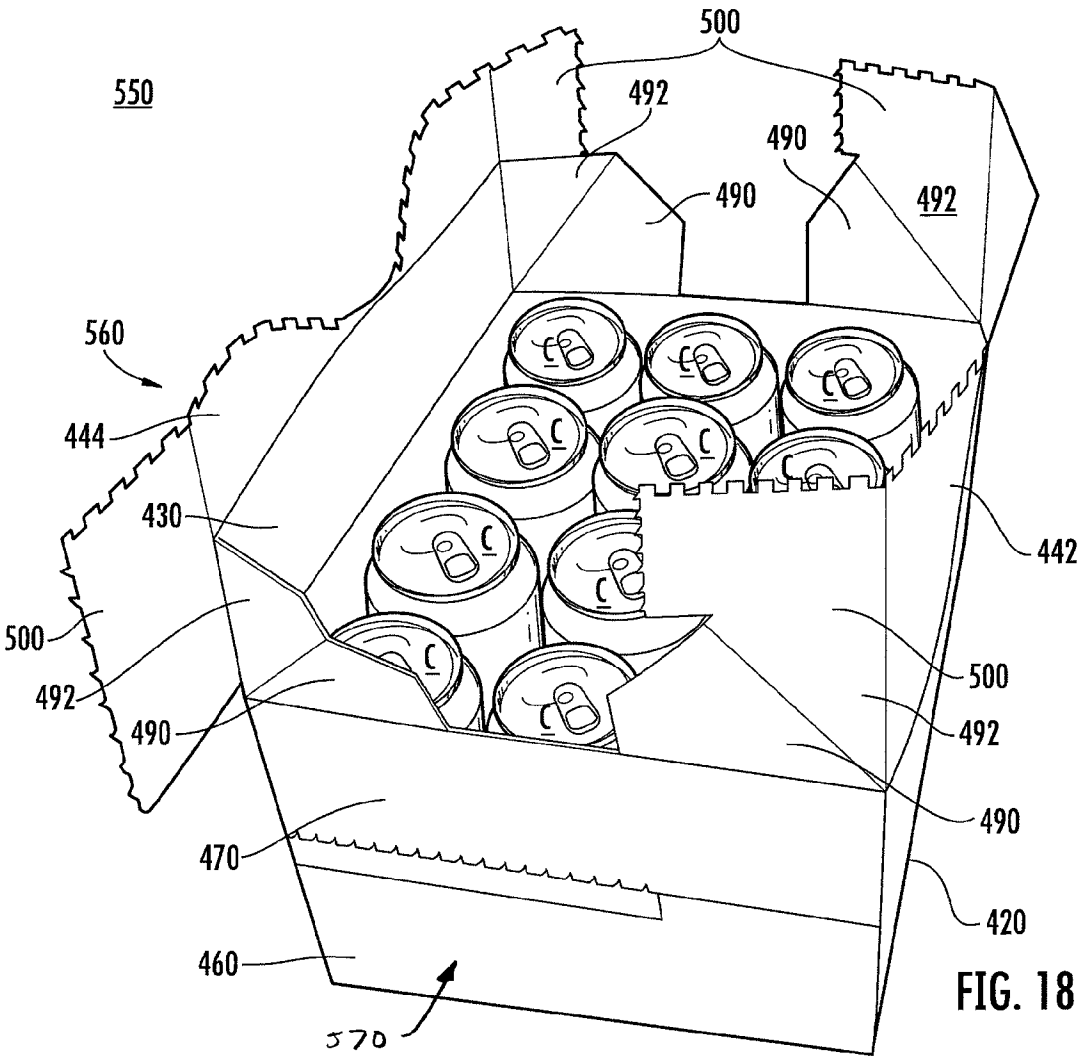

Referring to FIGS. 10, 12, and 18, the lower gussets 480 may define in part an at least partially liquid-tight bottom receptacle 570 in the erected carton 550. The height of the top edge or upper border of the bottom receptacle 570 corresponds to the marginal ends of the oblique fold lines 486 in the lower gussets 480 and represents a portion of the bottom of the carton 550 below which no glued seals or seams are formed through which water or other liquid might leak. That is, no adhesive seal or other joinder of material where fluid might escape the carton 550 is located in the carton at a position below the top edge of the bottom receptacle 570. The bottom receptacle 570 may therefore be formed from a continuous portion of folded material of the blank 405. The height of the bottom receptacle 570 may be, for example, defined as a function of a height of the carton 550. For example, the bottom receptacle 570 may define a liquid-tight portion having a height that is at least about 20% of the height of the erected and closed carton 550. In another embodiment, the receptacle 570 height may be at least about 40% of a height of the carton 550. The receptacle height may be increased or decreased, for example, to accommodate larger or smaller anticipated liquid volumes in the carton 550.

The blank 405 can, for example, be constructed of water resistant material to any degree desired so that liquid in the bottom of the carton 550 remains in the carton 550 for a selected amount of time.

In one embodiment, the carton 150 is formed by folding the first and second side panel 20 relative to the bottom panel 10 and the first and second top panel 30, 40 to form an open-ended sleeve. The bottom end panel 60 is upwardly folded so that the first and second lower gussets 80 are folded to form the liquid-tight bottom receptacle 170 and the upper gussets 88 are folded to close a respective end of the sleeve. Containers C can be loaded into the sleeve before closing either end of the sleeve, or the containers C can be loaded into the sleeve after closing one end of the sleeve. When the bottom end panel 60 is upwardly folded the first gusset panel 82 and the second gusset panel 84 are placed in generally face-to-face contact. Also, the folding of the bottom end panel 60 comprises folding the third gusset panel 90 relative to the fourth gusset panel 92. When the closure flap 70 is folded relative to the bottom end panel 60, the third gusset panel 90 is folded to be in face-to-face contact with the fourth gusset panel 92. The closure flap 70 can be secured to the second top panel 40 to close a respective end of the sleeve. The closure flap 70 can be secured by adhesively connecting the flap portions 74 to the second top panel 40.

In one embodiment, the carton 150 can be opened by tearing the closure flap 70 at tear lines 76 to separate the closure flap form the second top panel 40 and unfolding or expanding the upper gussets 88 and the lower gussets 80. Alternatively, the carton 150 can be opened by tearing the second top panel 40 at the line of disruption 50 and upwardly folding the two portions 42, 44 of the second top panel to expand or unfold the upper gussets 88. As alternatively disclosed in the second embodiment, the tear strip 502 can be torn to initiate opening of the carton 550 prior to tearing the second top panel 440 along the line of disruption 450. Other closing and/or opening configurations, steps, or methods can be used without departing from the scope of this disclosure.

Cartons according to the principles of the present disclosure may be formed from materials such as, for example, paperboard. Therefore, if exposed to water or other liquids for extended periods of time, the carton may allow for the passage of liquid through the wetted carton surfaces due to partial permeability of the carton material. In this specification, the term "liquid-tight" is generally used to define a portion of a carton that is formed from a continuous portion of material or of a portion without any glued seams through which liquid or fine particulate matter might leak, and the term "liquid-tight" therefore encompasses cartons that may become partially water permeable over time due to prolonged exposure to water or other liquids.

In the above embodiments, the cartons are described as accommodating eighteen 12-ounce cans containers C in 6×3×1 configuration, or twelve 12-ounce containers C in a 4×3×1 configuration. Other arrangements of containers, packages, articles, and other items, however, can be accommodated within a carton constructed according to the principles of the present disclosure. For example, a carton constructed according to the principles of the present disclosure would also work satisfactorily if the carton were sized and shaped to hold articles in other configurations, such as 3×4×1, 3×6×1, 2×4×1, 2×5×1, 2×6×1, 4×6×1, etc., and multi-tier variations of the aforementioned configurations.

The dimensions of the blanks may also be altered, for example, to accommodate various container forms. For example, 16-ounce petaloid bottles may be accommodated within a carton constructed according to the principles of the present disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper (e.g., a caliper of at least about 14). The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

The above embodiments may be described as having one or more panels adhered together by glue. The term "glue" is intended to encompass all manner of adhesives commonly used to secure carton panels in place.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In the present specification, a "panel" or "flap" need not be flat or otherwise planar. A "panel" or "flap" can, for example, comprise a plurality of interconnected generally flat or planar portions.

For purposes of the description presented herein, the term "line of disruption" can be used to generally refer to, for example, a cut line, a score line, a crease line, a tear line, or a fold line (or various sequential and/or overlapping combinations thereof) formed in a blank. A "breachable" line of disruption is a line of disruption that is intended to be breached during ordinary use of the carton. An example of a breachable line of disruption is a tear line.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In the illustrated embodiments, selected fold lines are shown as including spaced cuts to facilitate folding along the lines. If the cuts are below or adjacent to a bottom receptacle portion of a carton, less than 100% cuts may be used to prevent leakage along the fold lines. Alternatively, cuts or scores may be omitted within or near the receptacle portion.

The foregoing description of the disclosure illustrates and describes various exemplary embodiments. Various additions, modifications, changes, etc. could be made to the exemplary embodiments without departing from the spirit and scope of the claims. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton comprising:

a bottom panel;

a first side panel foldably connected to the bottom panel;

a second side panel foldably connected to the bottom panel;

a top wall foldably connected to the first side panel and the second side panel, a top wall breachable line of disruption extending at least partially across the top wall; and at least one end wall comprising a bottom end panel foldably connected to the bottom panel;

a closure flap foldably connected to the bottom end panel, the closure flap at least partially overlapping the top wall;

at least one lower gusset foldably connected to the bottom end panel and one of the first side panel and the second side panel; and at least one upper gusset foldably connected to the at least one lower gusset and the top wall.

2. The carton of claim 1 wherein the at least one lower gusset comprises a first lower gusset foldably connected to the bottom end panel and the first side panel and a second lower gusset foldably connected to the bottom end panel and the second side panel, and the at least one upper gusset comprises a first upper gusset foldably connected to the first lower gusset and the top wall and a second upper gusset foldably connected to the second lower gusset and the top wall.

3. The carton of claim 2, wherein the top wall breachable line of disruption comprises a curved portion terminating at each end in a generally straight portion.

4. The carton of claim 2, wherein the top wall breachable line of disruption comprises a generally straight tear line.

5. The carton of claim 2, wherein each of the first lower gusset and the second lower gusset comprises a first gusset panel foldably connected to a second gusset panel at a first oblique fold line, wherein the first gusset panel is foldably connected to the bottom end panel at a lateral fold line and the second gusset panel is connected to one of the first side panel and the second side panel at a longitudinal fold line.

6. The carton of claim 5, wherein the first gusset panel has a width in a lateral direction that is substantially equal to a width of the bottom end panel in the lateral direction, and the second gusset panel has a length in a longitudinal direction that is substantially equal to a length of one of the first and second side panels in the longitudinal direction.

7. The carton of claim 5, wherein each of the first upper gusset and the second upper gusset comprises a third gusset panel foldably connected to a fourth gusset panel at a second oblique fold line, wherein the third gusset panel is foldably connected to the second gusset panel at a lateral fold line and the fourth gusset panel is foldably connected to the top wall at the longitudinal fold line.

8. The carton of claim 7, wherein the third gusset panel has a width in the lateral direction that is substantially equal to the width of the second gusset panel in the lateral direction.

9. The carton of claim 2, wherein the top wall comprises a first top panel foldably connected to the first side panel and a second top panel foldably connected to the second side panel, and wherein the top wall breachable line of disruption extends across the second top panel.

10. A carton comprising:

a bottom panel;

a first side panel foldably connected to the bottom panel;

a second side panel foldably connected to the bottom panel;

a top wall foldably connected to the first side panel and the second side panel, a top wall breachable line of disruption extending at least partially across the top wall; and at least one end wall comprising a bottom end panel foldably connected to the bottom panel;

at least one lower gusset foldably connected to the bottom end panel and one of the first side panel and the second side panel; and at least one upper gusset foldably connected to the at least one lower gusset and the top wall;

wherein the at least one lower gusset comprises a first lower gusset foldably connected to the bottom end panel and the first side panel and a second lower gusset foldably connected to the bottom end panel and the second side panel, and the at least one upper gusset comprises a first upper gusset foldably connected to the first lower gusset and the top wall and a second upper gusset foldably connected to the second lower gusset and the top wall; and wherein the at least one end wall further comprises a closure flap foldably connected to the bottom end panel and an at least one breachable line of disruption in the closure flap.

11. The carton of claim 10, wherein the at least one breachable line of disruption comprises a first oblique tear line and a second oblique tear line forming adhesive flap portions of the closure flap, wherein the adhesive flap portions are adhered to the top wall and at least a portion of the first and second upper gussets are adhered to the closure flap.

12. A blank for forming a carton, the blank comprising:

a bottom panel;

a first side panel foldably connected to the bottom panel;

at least one top panel foldably connected to the first side panel and having a breachable line of disruption extending across the at least one top panel;

a second side panel foldably connected to the bottom panel;

at least one bottom end panel foldably connected to the bottom panel;

a closure flap foldably connected to the at least one bottom end panel, the closure flap being for at least partially overlapping the at least one top panel when the carton is formed from the blank;

at least one lower gusset foldably connected to the at least one bottom end panel and one of the first side panel and the second side panel; and at least one upper gusset foldably connected to the at least one lower gusset and the at least one top panel.

13. The blank of claim 12 wherein the at least one lower gusset comprises a first lower gusset foldably connected to the bottom end panel and the first side panel and a second lower gusset foldably connected to the bottom end panel and the second side panel, the at least one top panel comprises a first top panel foldably connected to the first side panel and a second top panel foldably connected to the second side panel, and the at least one upper gusset comprises a first upper gusset foldably connected to the first lower gusset and the first top panel and a second upper gusset foldably connected to the second lower gusset and the second top panel.

14. The blank of claim 13, wherein each of the first lower gusset and the second lower gusset comprises a first gusset panel foldably connected to a second gusset panel at a first oblique fold line, wherein the first gusset panel is foldably connected to the bottom end panel at a lateral fold line and the second gusset panel is connected to one of the first side panel and the second side panel at a longitudinal fold line.

15. The blank of claim 14, wherein the first gusset panel has a width in a lateral direction that is substantially equal to a width of the bottom end panel in the lateral direction, and the second gusset panel has a length in a longitudinal direction that is substantially equal to a length of one of the first and second side panels in the longitudinal direction.

16. The blank of claim 14, wherein each of the first upper gusset and the second upper gusset comprises a third gusset panel foldably connected to a fourth gusset panel at a second oblique fold line, wherein the third guest panel is foldably connected to the second gusset panel at a lateral fold line and the fourth gusset panel is foldably connected to one of the first top panel and the second top panel at the longitudinal fold line.

17. The blank of claim 16, wherein the third gusset panel has a width in the lateral direction that is substantially equal to the width of the second gusset panel in the lateral direction.

18. The blank of claim 13, wherein the breachable line of disruption extends across the second top panel.

19. A blank for forming a carton, the blank comprising:

a bottom panel;

a first side panel foldably connected to the bottom panel;

at least one top panel foldably connected to the first side panel and having a breachable line of disruption extending across the at least one top panel;

a second side panel foldably connected to the bottom panel;

at least one bottom end panel foldably connected to the bottom panel;

at least one lower gusset foldably connected to the at least one bottom end panel and one of the first side panel and the second side panel;

at least one upper gusset foldably connected to the at least one lower gusset and the at least one top panel; and a closure flap foldably connected to the bottom end panel and comprising at least one breachable line of disruption in the closure flap;

wherein the at least one lower gusset comprises a first lower gusset foldably connected to the bottom end panel and the first side panel and a second lower gusset foldably connected to the bottom end panel and the second side panel, the at least one top panel comprises a first top panel foldably connected to the first side panel and a second top panel foldably connected to the second side panel, and the at least one upper gusset comprises a first upper gusset foldably connected to the first lower gusset and the first top panel and a second upper gusset foldably connected to the second lower gusset and the second top panel.

20. The blank of claim 19, wherein the at least one breachable line of disruption comprises a first oblique tear line and a second oblique tear line forming adhesive flap portions of the closure flap, wherein the adhesive flap portions are adhered to the top wall and at least a portion of the first and second upper gussets are adhered to the closure flap.

21. A method of forming a carton for holding a plurality of containers, the method comprising:

providing a blank comprising a bottom panel, a first side panel foldably connected to the bottom panel, at least one top panel foldably connected to the first side panel and having a breachable line of disruption extending across the at least one top panel, a second side panel foldably connected to the bottom panel, at least one bottom end panel foldably connected to the bottom panel, a closure flap foldably connected to the at least one bottom end panel, at least one lower gusset foldably connected to the at least one bottom end panel and one of the first side panel and the second side panel, and at least one upper gusset foldably connected to the at least one lower gusset and the at least one top panel;

folding the first side panel and the second side panel relative to the bottom panel and the at least one top panel to form a sleeve; and folding the bottom end panel so that the least one lower gusset is folded to form a liquid-tight bottom receptacle and the at least one first lower upper gusset is folded; and folding the closure flap to at least partially overlap the at least one top panel.

22. The method of claim 21 wherein the at least one lower gusset comprises a first lower gusset foldably connected to the bottom end panel and the first side panel and a second lower gusset foldably connected to the bottom end panel and the second side panel, the at least one top panel comprises a first top panel and a second top panel, and the at least one upper gusset comprises a first upper gusset foldably connected to the first lower gusset and the first top panel and a second upper gusset foldably connected to the second lower gusset and the second top panel, each of the first lower gusset and the second lower gusset comprises a first gusset panel foldably connected to a second gusset panel at a first oblique fold line, wherein the first gusset panel is foldably connected to the bottom end panel at a lateral fold line and the second gusset panel is connected to one of the first side panel and the second side panel at a longitudinal fold line, and the folding the bottom end panel upwards comprises folding the first gusset panel to be in face-to-face contact with the second gusset panel.

23. The method of claim 21, wherein the at least one top panel comprises a first top panel foldably connected to the first side panel and a second top panel foldably connected to the second side panel, and wherein the top wall breachable line of disruption extends across the second top panel, the method further comprises opening the carton by tearing the second top panel at the breachable line of disruption and expanding the at least one upper gusset.

24. A method of forming a carton for holding a plurality of containers, the method comprising:

providing a blank comprising a bottom panel, a first side panel foldably connected to the bottom panel, at least one top panel foldably connected to the first side panel and having a breachable line of disruption extending across the at least one top panel, a second side panel foldably connected to the bottom panel, at least one bottom end panel foldably connected to the bottom panel, at least one lower gusset foldably connected to the at least one bottom end panel and one of the first side panel and the second side panel, and at least one upper gusset foldably connected to the at least one lower gusset and the at least one top panel;

folding the first side panel and the second side panel relative to the bottom panel and the at least one top panel to form a sleeve; and folding the bottom end panel so that the least one lower gusset is folded to form a liquid-tight bottom receptacle and the at least one upper gusset is folded;

wherein the at least one lower gusset comprises a first lower gusset foldably connected to the bottom end panel and the first side panel and a second lower gusset foldably connected to the bottom end panel and the second side panel, the at least one top panel comprises a first top panel and a second top panel, and the at least one upper gusset comprises a first upper gusset foldably connected to the first lower gusset and the first top panel and a second upper gusset foldably connected to the second lower gusset and the second top panel, each of the first lower gusset and the second lower gusset comprises a first gusset panel foldably connected to a second gusset panel at a first oblique fold line, wherein the first gusset panel is foldably connected to the bottom end panel at a lateral fold line and the second gusset panel is connected to one of the first side panel and the second side panel at a longitudinal fold line, and the folding the bottom end panel upwards comprises folding the first gusset panel to be in face-to-face contact with the second gusset panel;

wherein each of the first upper gusset and the second upper gusset comprises a third gusset panel foldably connected to a fourth gusset panel at a second oblique fold line, wherein the third gusset panel is foldably connected to the second gusset panel at a lateral fold line and the fourth gusset panel is foldably connected to one of the first top panel and the second top panel at the longitudinal fold line, the at least one end wall further comprises a closure flap foldably connected to the bottom end panel and an at least one breachable line of disruption in the closure flap, and the folding of the bottom end panel comprises folding the third gusset panel relative to the fourth gusset panel.

25. The method of claim 24 further comprises folding the closure flap relative to the bottom end panel and securing the closure flap to the at least one top panel, the folding the closure flap comprising folding the third gusset panel to be in face-to-face contact with the fourth gusset panel.

26. The method of claim 25, wherein the at least one breachable line of disruption comprises a first oblique tear line and a second oblique tear line forming adhesive flap portions of the closure flap, and the securing the closure flap comprises adhesively connecting the flap portions to the at least one top panel.

* * * * *